US009612555B2

(12) United States Patent
Yoshinaga et al.

(10) Patent No.: US 9,612,555 B2
(45) Date of Patent: Apr. 4, 2017

(54) FIXING DEVICE, IMAGE FORMING APPARATUS, AND FIXING METHOD FOR CONVEYING TONER IMAGES

(71) Applicants: Hiroshi Yoshinaga, Chiba (JP); Kenji Ishii, Kanagawa (JP); Kazuhito Kishi, Kanagawa (JP); Takashi Seto, Kanagawa (JP); Takayuki Seki, Kanagawa (JP); Ippei Fujimoto, Kanagawa (JP); Kazunari Sawada, Tokyo (JP); Susumu Matsusaka, Kanagawa (JP); Yasuhiko Ogino, Kanagawa (JP); Shohta Kobashigawa, Tokyo (JP)

(72) Inventors: Hiroshi Yoshinaga, Chiba (JP); Kenji Ishii, Kanagawa (JP); Kazuhito Kishi, Kanagawa (JP); Takashi Seto, Kanagawa (JP); Takayuki Seki, Kanagawa (JP); Ippei Fujimoto, Kanagawa (JP); Kazunari Sawada, Tokyo (JP); Susumu Matsusaka, Kanagawa (JP); Yasuhiko Ogino, Kanagawa (JP); Shohta Kobashigawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/010,012

(22) Filed: Jan. 29, 2016

(65) Prior Publication Data

US 2016/0223963 A1 Aug. 4, 2016

(30) Foreign Application Priority Data

Feb. 4, 2015 (JP) ..... 2015-020320

(51) Int. Cl.
*G03G 15/20* (2006.01)

(52) U.S. Cl.
CPC ..... *G03G 15/2053* (2013.01); *G03G 15/205* (2013.01); *G03G 15/2042* (2013.01); *G03G 2215/2035* (2013.01)

(58) Field of Classification Search
CPC ..... G03G 15/2053
(Continued)

(56) References Cited

U.S. PATENT DOCUMENTS

2013/0164059 A1 6/2013 Takagi et al.
2013/0170879 A1 7/2013 Yoshinaga et al.
(Continued)

FOREIGN PATENT DOCUMENTS

JP 2013-164430 8/2013

*Primary Examiner* — Quana M Grainger
(74) *Attorney, Agent, or Firm* — Oblon, McClelland, Maier & Neustadt, L.L.P.

(57) ABSTRACT

A fixing device includes a fixing rotator and an opposed rotator pressed against the fixing rotator to form a fixing nip therebetween. A primary heater is disposed opposite the fixing rotator in a circumferential span of the fixing rotator other than the fixing nip in a circumferential direction of the fixing rotator to heat the fixing rotator. A heat shield is interposed between the primary heater and the fixing rotator and disposed outboard from at least a decreased size recording medium conveyance span of the fixing rotator spanning in an axial direction of the fixing rotator where a recording medium having a decreased size in the axial direction of the fixing rotator is conveyed. The heat shield shields the fixing rotator from the primary heater. A secondary heater is mounted on the heat shield to heat the fixing rotator.

21 Claims, 13 Drawing Sheets

(58) Field of Classification Search
USPC ..... 399/329
See application file for complete search history.

(56) References Cited

U.S. PATENT DOCUMENTS

| | | | | |
|---|---|---|---|---|
| 2013/0170880 | A1 | 7/2013 | Gotoh et al. | |
| 2013/0183070 | A1 | 7/2013 | Kawata et al. | |
| 2013/0183071 | A1 | 7/2013 | Iwaya et al. | |
| 2013/0183072 | A1* | 7/2013 | Hase ..... | G03G 15/2053 399/329 |
| 2014/0356036 | A1 | 12/2014 | Shimokawa et al. | |
| 2015/0063884 | A1 | 3/2015 | Iwaya et al. | |
| 2015/0160591 | A1 | 6/2015 | Hase et al. | |

* cited by examiner

FIXING DEVICE, IMAGE FORMING APPARATUS, AND FIXING METHOD FOR CONVEYING TONER IMAGES

CROSS-REFERENCE TO RELATED APPLICATION

This patent application is based on and claims priority pursuant to 35 U.S.C. §119 to Japanese Patent Application No. 2015-020320, filed on Feb. 4, 2015, in the Japanese Patent Office, the entire disclosure of which is hereby incorporated by reference herein.

BACKGROUND

Technical Field

Exemplary aspects of the present disclosure relate to a fixing device, an image forming apparatus, and a fixing method, and more particularly, to a fixing device for fixing a toner image on a recording medium, an image forming apparatus incorporating the fixing device, and a fixing method performed by the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and an opposed rotator pressed against the fixing rotator to form a fixing nip therebetween, through which a recording medium bearing a toner image is conveyed. A primary heater is disposed opposite the fixing rotator in a circumferential span of the fixing rotator other than the fixing nip in a circumferential direction of the fixing rotator to heat the fixing rotator. A heat shield is interposed between the primary heater and the fixing rotator and disposed outboard from at least a decreased size recording medium conveyance span of the fixing rotator spanning in an axial direction of the fixing rotator where the recording medium having a decreased size in the axial direction of the fixing rotator is conveyed. The heat shield shields the fixing rotator from the primary heater. A secondary heater is mounted on the heat shield to heat the fixing rotator.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing rotator rotatable in a predetermined direction of rotation and an opposed rotator pressed against the fixing rotator to form a fixing nip therebetween, through which the recording medium bearing the toner image is conveyed. A primary heater is disposed opposite the fixing rotator in a circumferential span of the fixing rotator other than the fixing nip in a circumferential direction of the fixing rotator to heat the fixing rotator. A heat shield is interposed between the primary heater and the fixing rotator and disposed outboard from at least a decreased size recording medium conveyance span of the fixing rotator spanning in an axial direction of the fixing rotator where the recording medium having a decreased size in the axial direction of the fixing rotator is conveyed. The heat shield shields the fixing rotator from the primary heater. A secondary heater is mounted on the heat shield to heat the fixing rotator.

This specification further describes an improved fixing method. In one exemplary embodiment, the fixing method includes receiving a print job; energizing a primary heater to heat a fixing rotator; determining that a width of a recording medium is greater than a predetermined width; energizing a secondary heater to heat the fixing rotator; determining that a warm-up time has elapsed; detecting a preset temperature of the fixing rotator; rotating the fixing rotator at a preset linear velocity; and conveying the recording medium to the fixing rotator.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
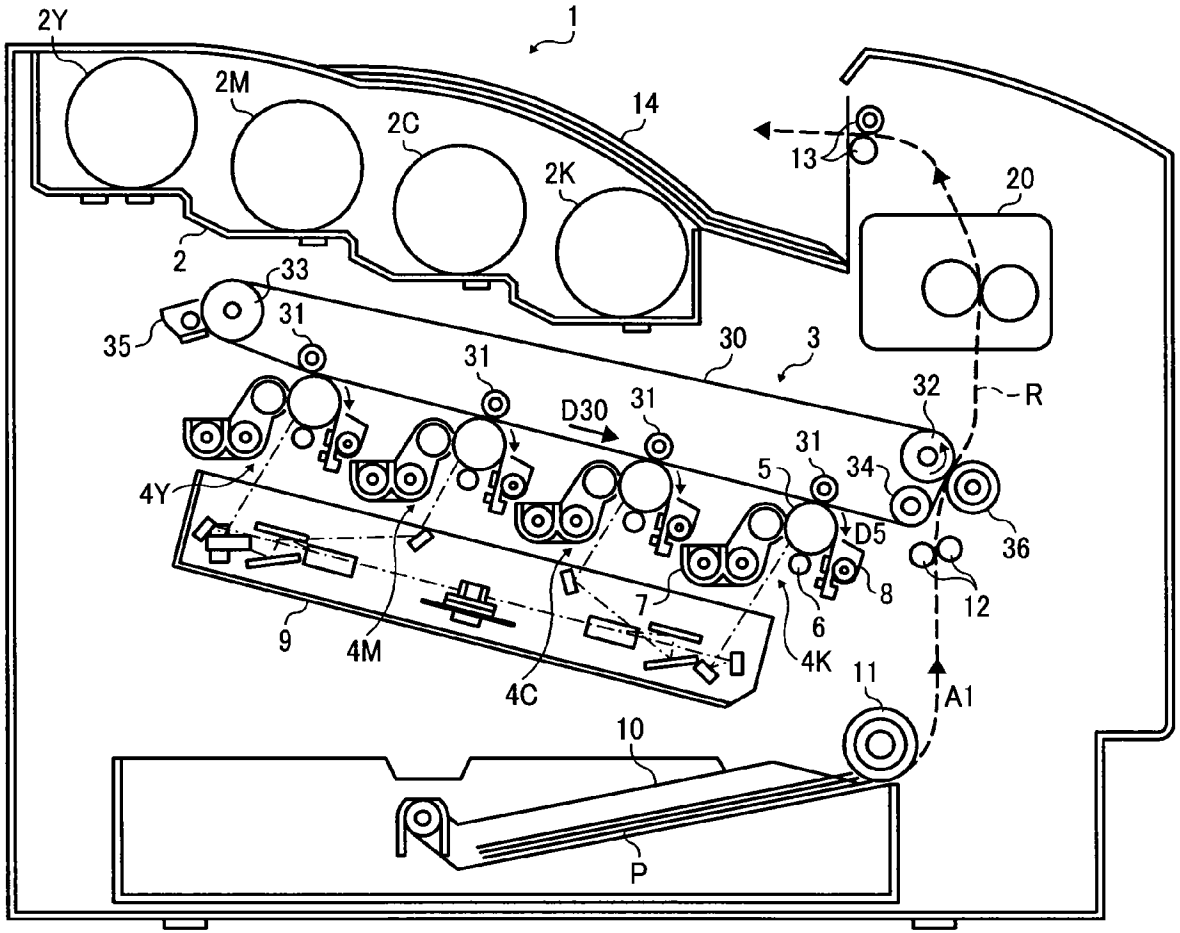
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on a recording medium by electrophotography. Alternatively, the image forming apparatus 1 may be a monochrome printer that forms a monochrome toner image on a recording medium.

With reference to FIG. 1, a description is provided of a construction of the image forming apparatus 1.

As shown in FIG. 1, the image forming apparatus 1 includes four image forming devices 4Y, 4M, 4C, and 4K situated in a center portion thereof. Although the image forming devices 4Y, 4M, 4C, and 4K contain developers in different colors, that is, yellow, magenta, cyan, and black corresponding to color separation components of a color image (e.g., yellow, magenta, cyan, and black toners), respectively, they have an identical structure.

For example, each of the image forming devices 4Y, 4M, 4C, and 4K includes a drum-shaped photoconductor 5 serving as an image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5.

It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35. The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween. The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are connected to a power supply that applies a predetermined direct current (DC) voltage and/or alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current (DC) voltage and/or alternating current (AC) voltage thereto. The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively. In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a conveyor conveys the sheet P conveyed from the feed roller 11 toward the secondary transfer nip. The conveyance path R is further provided with a fixing device 20 located above the secondary transfer nip, that is, downstream from the secondary transfer nip in the sheet conveyance direction A1. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction A1. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

With reference to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each of the primary transfer nips formed between the photoconductors 5 and the primary transfer rollers 31, respectively. When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30.

After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 conveys the sheet P sent to the conveyance path R by the feed roller 11 to the secondary transfer nip formed between the secondary transfer roller 36 and the intermediate transfer belt 30 at a proper time.

The secondary transfer roller 36 is applied with a transfer voltage having a polarity opposite a polarity of the charged yellow, magenta, cyan, and black toners constituting the full color toner image formed on the intermediate transfer belt 30, thus creating a transfer electric field at the secondary transfer nip. As the yellow, magenta, cyan, and black toner images constituting the full color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively.

After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container. Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stacks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
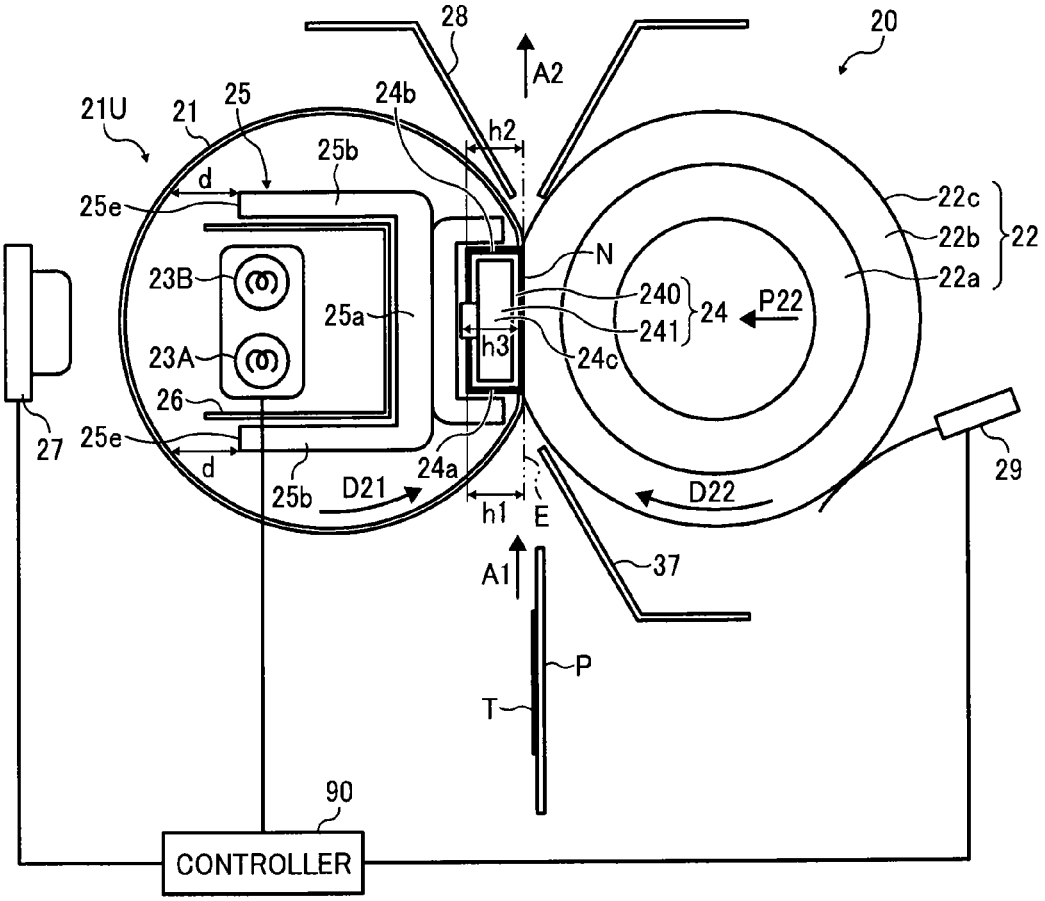
FIG. 2 is a schematic vertical sectional view of a fixing device according to a first exemplary embodiment of the present disclosure that is incorporated in the image forming apparatus shown in FIG. 1.

With reference to FIG. 2, a description is provided of a construction of the fixing device 20 according to a first exemplary embodiment that is incorporated in the image forming apparatus 1 described above.

FIG. 2 is a schematic vertical sectional view of the fixing device 20. As shown in FIG. 2, the fixing device 20 (e.g., a fuser or a fusing unit) includes a flexible, endless fixing belt 21, serving as an endless belt, a fixing rotator, or a fixing member, formed into a loop and rotatable in a rotation direction D21 and a pressure roller 22 serving as an opposed rotator disposed outside the loop formed by the fixing belt 21 and disposed opposite the fixing belt 21. The pressure roller 22 is rotatable in a rotation direction D22.

The fixing device 20 further includes two halogen heaters, that is, a first halogen heater 23A and a second halogen heater 23B, a nip formation pad 24, and a stay 25 disposed inside the loop formed by the fixing belt 21. The first halogen heater 23A and the second halogen heater 23B, serving as a primary heater or a primary heat source, heat the fixing belt 21. The nip formation pad 24 presses against the pressure roller 22 via the fixing belt 21 to form a fixing nip N between the fixing belt 21 and the pressure roller 22, through which a sheet P bearing a toner image T is conveyed. The stay 25, serving as a support, supports the nip formation pad 24.

The first halogen heater 23A and the second halogen heater 23B are disposed opposite the fixing belt 21 in a circumferential span thereof other than the fixing nip N in a circumferential direction of the fixing belt 21. For example, the first halogen heater 23A and the second halogen heater 23B are disposed opposite a non-nip side portion of the fixing belt 21 opposite a nip side portion of the fixing belt 21 that is disposed opposite the fixing nip N. The non-nip side portion of the fixing belt 21 is outside the fixing nip N in the circumferential direction of the fixing belt 21.

The fixing device 20 further includes a reflector 26, a thermopile 27, a thermistor 29, and a separator 28. The reflector 26 reflects light emitted from each of the first halogen heater 23A and the second halogen heater 23B to the fixing belt 21. The thermopile 27, serving as a temperature detector, detects the temperature of the fixing belt 21. The thermistor 29, serving as a temperature detector, detects the temperature of the pressure roller 22. The separator 28 separates the sheet P from the fixing belt 21. The fixing device 20 further includes a pressurization assembly that presses the pressure roller 22 against the fixing belt 21. The fixing belt 21 and the components disposed inside the loop formed by the fixing belt 21, that is, the first halogen heater 23A, the second halogen heater 23B, the nip formation pad 24, the stay 25, and the reflector 26, may constitute a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting an outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

A detailed description is now given of a construction of the pressure roller 22.

The pressure roller 22 is constructed of a cored bar 22*a*; an elastic layer 22*b* coating the cored bar 22*a* and made of silicone rubber foam, silicone rubber, fluoro rubber, or the like; and a release layer 22*c* coating the elastic layer 22*b* and made of PFA, PTFE, or the like. The pressurization assembly presses the pressure roller 22 against the nip formation pad 24 via the fixing belt 21 to form the fixing nip N between the fixing belt 21 and the pressure roller 22. The pressure roller 22 pressingly contacting the fixing belt 21 deforms the elastic layer 22*b* of the pressure roller 22 at the fixing nip N formed between the pressure roller 22 and the fixing belt 21, thus defining the fixing nip N having a predetermined length in the sheet conveyance direction A1. A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

According to this exemplary embodiment, the pressure roller 22 is a hollow roller. Alternatively, the pressure roller 22 may be a solid roller. A heater such as a halogen heater may be disposed inside the pressure roller 22. If the pressure roller 22 does not incorporate the elastic layer 22*b*, the pressure roller 22 has a decreased thermal capacity that improves a fixing property of being heated quickly to a predetermined fixing temperature at which a toner image T is fixed on a sheet P properly. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T. To address this problem, it is preferable that the pressure roller 22 incorporates the elastic layer 22*b* having a thickness not smaller than about 100 micrometers. The elastic layer 22*b* having the thickness not smaller than 100 micrometers elastically deforms to absorb slight surface asperities of the fixing belt 21, preventing variation in gloss of the toner image T on the sheet P.

The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21. According to this exemplary embodiment, the pressure roller 22 is pressed against the fixing belt 21. Alternatively, the pressure roller 22 may merely contact the fixing belt 21 with no pressure therebetween.

A detailed description is now given of a configuration of the first halogen heater 23A and the second halogen heater 23B.

Both lateral ends of each of the first halogen heater 23A and the second halogen heater 23B in a longitudinal direction thereof parallel to an axial direction of the fixing belt 21 are mounted on or fixedly secured to side plates of the fixing device 20, respectively. The power supply situated inside the image forming apparatus 1 supplies power to the first halogen heater 23A and the second halogen heater 23B to generate heat. A controller 90 (e.g., a processor), that is, a central processing unit (CPU) provided with a random-access memory (RAM) and a read-only memory (ROM), for example, operatively connected to the first halogen heater 23A and the second halogen heater 23B, the thermopile 27, and the thermistor 29 controls the first halogen heater 23A and the second halogen heater 23B based on the temperature of the outer circumferential surface of the fixing belt 21 detected by the thermopile 27 so as to adjust the temperature of the fixing belt 21 to a desired fixing temperature. It is to be noted that the controller 90 may be situated inside the fixing device 20 or the image forming apparatus 1 depicted in FIG. 1. Alternatively, a heater or a heat generator other than the first halogen heater 23A and the second halogen heater 23B may be employed as a heater that heats the fixing belt 21.

A detailed description is now given of a construction of the nip formation pad 24.

The nip formation pad 24 includes a base pad 241 and a slide sheet 240 (e.g., a low-friction sheet) disposed on a surface of the base pad 241. The base pad 241 extends in a longitudinal direction thereof parallel to the axial direction of the fixing belt 21 or the pressure roller 22 to contour the fixing nip N as the base pad 241 receives pressure from the pressure roller 22. The base pad 241 is mounted on and supported by the stay 25. Accordingly, even if the nip formation pad 24 receives pressure from the pressure roller 22, the nip formation pad 24 is not bent by the pressure and therefore produces a uniform nip length throughout the entire width of the pressure roller 22 in the axial direction thereof. The stay 25 is made of metal having an increased mechanical strength, such as stainless steel and iron, to prevent bending of the nip formation pad 24. The base pad 241 is made of a rigid material to secure the mechanical strength of the nip formation pad 24.

For example, the base pad 241 is made of resin such as liquid crystal polymer (LCP), metal, ceramic, or the like. The base pad 241 is made of a heat resistant material resistant against temperatures of about 200 degrees centigrade or higher. Thus, the nip formation pad 24 is immune from thermal deformation at temperatures in a fixing temperature range desirable to fix the toner image T on the sheet P, retaining the shape of the fixing nip N and quality of the toner image T formed on the sheet P. For example, the base pad 241 is made of general heat resistant resin such as polyether sulfone (PES), polyphenylene sulfide (PPS), liquid crystal polymer (LCP), polyether nitrile (PEN), polyamide imide (PAI), and polyether ether ketone (PEEK).

The slide sheet 240 is disposed on at least an opposed face of the base pad 241 disposed opposite the fixing belt 21. As the fixing belt 21 rotates in the rotation direction D21, the fixing belt 21 slides over the slide sheet 240 that reduces a driving torque developed between the fixing belt 21 and the nip formation pad 24, reducing load exerted to the fixing belt 21 by friction between the fixing belt 21 and the nip formation pad 24. Alternatively, the nip formation pad 24 may not incorporate the slide sheet 240.

A detailed description is now given of a configuration of the reflector 26.

The reflector 26 is interposed between the stay 25 and the first halogen heater 23A and the second halogen heater 23B. The reflector 26 is made of aluminum, stainless steel, or the like. The reflector 26 reflects light radiated from the first halogen heater 23A and the second halogen heater 23B to the stay 25 toward the fixing belt 21, increasing an amount of light that irradiates the fixing belt 21 and thereby heating the fixing belt 21 effectively. The reflector 26 suppresses conduction of heat from the first halogen heater 23A and the second halogen heater 23B to the stay 25 and the like, saving energy.

A description is provided of various configurations of the fixing device 20 to achieve advantages such as saving energy and shortening of a first print time taken to output the sheet P bearing the fixed toner image T upon receipt of a print job through preparation for a print operation and the subsequent print operation.

For example, the fixing device 20 employs a direct heating method in which the first halogen heater 23A and the second halogen heater 23B heat the fixing belt 21 directly in a circumferential direct heating span on the fixing belt 21 other than the fixing nip N. As shown in FIG. 2, no component is interposed between the first halogen heater 23A and the second halogen heater 23B and the fixing belt 21 in the circumferential direct heating span on the fixing belt 21 on the left of the first halogen heater 23A and the second halogen heater 23B where the first halogen heater 23A and the second halogen heater 23B heat the fixing belt 21 directly with radiation heat.

In order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm. Additionally, the loop diameter of the fixing belt 21 may not be greater than 30 mm.

According to this exemplary embodiment, the pressure roller 22 has a diameter in a range of from 20 mm to 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22. In this case, a curvature of the fixing belt 21 is greater than a curvature of the pressure roller 22 at the fixing nip N, facilitating separation of the sheet P from the fixing belt 21 as it is ejected from the fixing nip N.

The fixing belt 21 having the decreased loop diameter as described above downsizes a space produced inside the loop formed by the fixing belt 21. To address this circumstance, according to this exemplary embodiment, the stay 25 is bent at both ends thereof in the sheet conveyance direction A1 to produce a recess that accommodates the first halogen heater 23A and the second halogen heater 23B. Thus, the downsized space inside the loop formed by the fixing belt 21 accommodates the stay 25 and the first halogen heater 23A and the second halogen heater 23B.

In order to allow the stay 25 to occupy an increased volume in the downsized space inside the loop formed by the fixing belt 21, the nip formation pad 24 is downsized and compact. For example, a length of the base pad 241 is smaller than a length of the stay 25 in the sheet conveyance direction A1. The base pad 241 includes an upstream portion 24*a*, a downstream portion 24*b*, and an intermediate portion 24*c* in the sheet conveyance direction A1. The upstream portion 24*a*, the downstream portion 24*b*, and the intermediate portion 24*c* have heights h1, h2, and h3, respectively, in a direction perpendicular to the fixing nip N or a hypothetical extension E in the sheet conveyance direction A1. The height h1 is not greater than the height h3. The height h2 is not greater than the height h3. The stay 25 includes an upstream arm 25*b* and a downstream arm 25*b* in the sheet conveyance direction A1. The upstream portion 24*a* of the base pad 241 is not interposed between the upstream arm 25*b* of the stay 25 and the fixing belt 21. The downstream portion 24*b* of the base pad 241 is not interposed between the downstream arm 25*b* of the stay 25 and the fixing belt 21. Thus, the nip formation pad 24 allows the upstream arm 25*b* and the downstream arm 25*b* of the stay 25 to be disposed close to the inner circumferential surface of the fixing belt 21.

Accordingly, the stay 25 is upsized in the limited space inside the loop formed by the fixing belt 21, attaining an increased mechanical strength of the stay 25. Consequently, the stay 25 prevents the nip formation pad 24 from being bent by pressure from the pressure roller 22, enhancing a fixing property of exerting pressure to the fixing nip N properly.

A detailed description is now given of a construction of the stay 25.

In order to attain the mechanical strength great enough to support the nip formation pad 24 against pressure from the pressure roller 22, the stay 25 includes a base 25*a*, the upstream arm 25*b*, and the downstream arm 25*b*. The base 25*a* extends in the sheet conveyance direction A1 and contacts the nip formation pad 24. The upstream arm 25*b* projects from an upstream end of the base 25*a* in a pressurization direction P22 in which the pressure roller 22 presses against the nip formation pad 24 via the fixing belt 21. The downstream arm 25*b* projects from a downstream end of the base 25*a* in the pressurization direction P22. The upstream arm 25*b* and the downstream arm 25*b* elongate the stay 25 in the pressurization direction P22 of the pressure roller 22, increasing the section modulus and the mechanical strength of the stay 25.

As the upstream arm 25*b* and the downstream arm 25*b* are elongated in the pressurization direction P22 of the pressure roller 22, the mechanical strength of the stay 25 increases. Hence, it is preferable that an edge 25*e* of each of the upstream arm 25*b* and the downstream arm 25*b* is in proximity to the inner circumferential surface of the fixing belt 21. However, since the fixing belt 21 may suffer from unstable motion (e.g., vibration or shaking) during rotation, if the edge 25*e* of each of the upstream arm 25*b* and the downstream arm 25*b* is in proximity to the inner circumferential surface of the fixing belt 21 excessively, the fixing belt 21 may come into contact with the edge 25*e* of each of the upstream arm 25*b* and the downstream arm 25*b*. For example, the thin fixing belt 21 according to this exemplary embodiment may vibrate or shake in an increased amount. To address this circumstance, the edge 25*e* of each of the upstream arm 25*b* and the downstream arm 25*b* is positioned relative to the inner circumferential surface of the fixing belt 21 carefully.

According to this exemplary embodiment, an interval d of at least 2.0 mm, preferably 3.0 mm or greater, is provided between the edge 25*e* of each of the upstream arm 25*b* and the downstream arm 25*b* and the inner circumferential surface of the fixing belt 21 in the pressurization direction P22 of the pressure roller 22. If the fixing belt 21 has an increased thickness and therefore barely vibrates or shakes, the interval d is 0.02 mm. The edge 25*e* of each of the upstream arm 25*b* and the downstream arm 25*b* that is in proximity to the inner circumferential surface of the fixing belt 21 allows the upstream arm 25*b* and the downstream arm 25*b* to be elongated in the pressurization direction P22 of the pressure roller 22. Accordingly, even if the fixing belt 21 has the decreased loop diameter, the stay 25 achieves the increased mechanical strength.

A description is provided of a fixing operation of the fixing device 20 to fix a toner image T on a sheet P.

As the image forming apparatus 1 depicted in FIG. 1 is powered on, the first halogen heater 23A and the second halogen heater 23B are supplied with power and the driver starts driving and rotating the pressure roller 22 clockwise in FIG. 2 in the rotation direction D22. The fixing belt 21 is driven and rotated counterclockwise in FIG. 2 in the rotation direction D21 by friction between the fixing belt 21 and the pressure roller 22. Thereafter, the sheet P bearing the unfixed toner image T formed in the image forming processes described above is conveyed in the sheet conveyance direction A1 while guided by a guide plate 37 and enters the fixing nip N formed between the fixing belt 21 and the pressure roller 22 pressed against the fixing belt 21. The toner image T is fixed on the sheet P under heat from the fixing belt 21 heated by the first halogen heater 23A and the second halogen heater 23B and pressure exerted from the fixing belt 21 and the pressure roller 22.

The sheet P bearing the fixed toner image T is ejected from the fixing nip N and conveyed in a sheet conveyance direction A2. As a leading edge of the sheet P contacts a front edge of the separator 28, the separator 28 separates the sheet P from the fixing belt 21. The sheet P separated from the fixing belt 21 is ejected by the output roller pair 13 depicted in FIG. 1 onto the outside of the image forming apparatus 1, that is, the output tray 14 that stacks the sheet P.

A description is provided of a configuration of a first comparative fixing device incorporating a thin tubular fixing belt.

The thin fixing belt having a decreased thermal capacity shortens a warm-up time taken to heat the fixing belt to a predetermined fixing temperature appropriate for fixing a toner image on a sheet from an ambient temperature after an image forming apparatus incorporating the first comparative fixing device is powered on and a first print time taken to output the sheet bearing the fixed toner image upon receipt of a print job through preparation for a print operation and the subsequent print operation.

A platy nip formation pad extending in an axial direction of the fixing belt is disposed inside a loop formed by the fixing belt. A pressure roller is pressed against the nip formation pad via the fixing belt to form a fixing nip between the pressure roller and the fixing belt. A plurality of halogen heaters situated inside the loop formed by the fixing belt faces a non-nip side portion of an inner circumferential surface of the fixing belt that is opposite a nip side portion contacting the nip formation pad. The halogen heaters include light emitters having different light emission spans in the axial direction of the fixing belt, respectively. Each of the halogen heaters is powered on and off according to the size of the sheet.

The light intensity of the light emitter of the respective halogen heaters decreases at a lateral end of the light emitter in a longitudinal direction of the halogen heaters parallel to the axial direction of the fixing belt. Accordingly, if the light emission span is equivalent to a conveyance span of the fixing belt where the sheet is conveyed, a temperature distribution of each lateral end of the conveyance span of the fixing belt may decrease compared to a temperature distribution of a center of the conveyance span of the fixing belt when warm-up of the fixing belt has finished or when conveyance of the sheet to the fixing belt starts. To address this circumstance, the light emitter of the respective halogen heaters is elongated to achieve the light emission span greater than the conveyance span of the fixing belt in the axial direction thereof so that a part of the light emission span that achieves a uniform light intensity spans the conveyance span of the fixing belt in the axial direction thereof. Thus, even when an initial sheet of a print job is conveyed over the fixing belt, each lateral end of the light emitter in the axial direction of the fixing belt attains a fixing property of heating the fixing belt to a desired fixing temperature at which the toner image is fixed on the sheet properly.

However, even if an elongated part of the light emitter generates a decreased amount of heat, when a plurality of sheets is conveyed continuously, the sheets do not draw heat from a part of the fixing belt that is disposed opposite the elongated part of the light emitter, resulting in overheating of the part of the fixing belt to temperatures higher than a heat resistant temperature of the fixing belt. To address this circumstance, a heat shield may be interposed between the halogen heaters and the fixing belt to shield the fixing belt from the halogen heaters.

Large sheets, so-called special size sheets, greater than an A3 size sheet may be used in the image forming apparatus. The large sheets include an A3 extension size sheet, a 12-inch sheet, and a 13-inch sheet. To address this circumstance, the first comparative fixing device may incorporate a separate halogen heater having a light distribution corresponding to those large sheets. However, it may be difficult to place the separate halogen heater inside the loop formed by the downsized fixing belt. Alternatively, the light emitter of the halogen heater may be elongated to an increased light emission span great enough to heat a lateral end of the large sheet in the axial direction of the fixing belt.

On the other hand, the heat shield is designed to prevent the elongated part of the light emitter configured to suppress temperature decrease in a lateral end of the A3 size sheet in portrait orientation and the A4 size sheet in landscape orientation that are used frequently from overheating the fixing belt. Accordingly, when the large sheet such as the A3 extension size sheet is conveyed over the fixing belt, a part of the heat shield configured to shield an A3 size sheet conveyance span of the fixing belt where the A3 size sheet is conveyed may unnecessarily shield a large sheet conveyance span of the fixing belt where the large sheet is conveyed, causing fixing failure at the lateral end of the large sheet. To address this circumstance, the part of the heat shield that shields the A3 size sheet conveyance span of the fixing belt may be partially eliminated into a trapezoid to change the shield area. However, modification of the shape of the heat shield may not prevent fixing failure at the lateral end of the large sheet sufficiently.

With reference to FIGS. 3 to 7, a description is provided of a configuration and disadvantages of a second comparative fixing device 20C.

Figure 3:
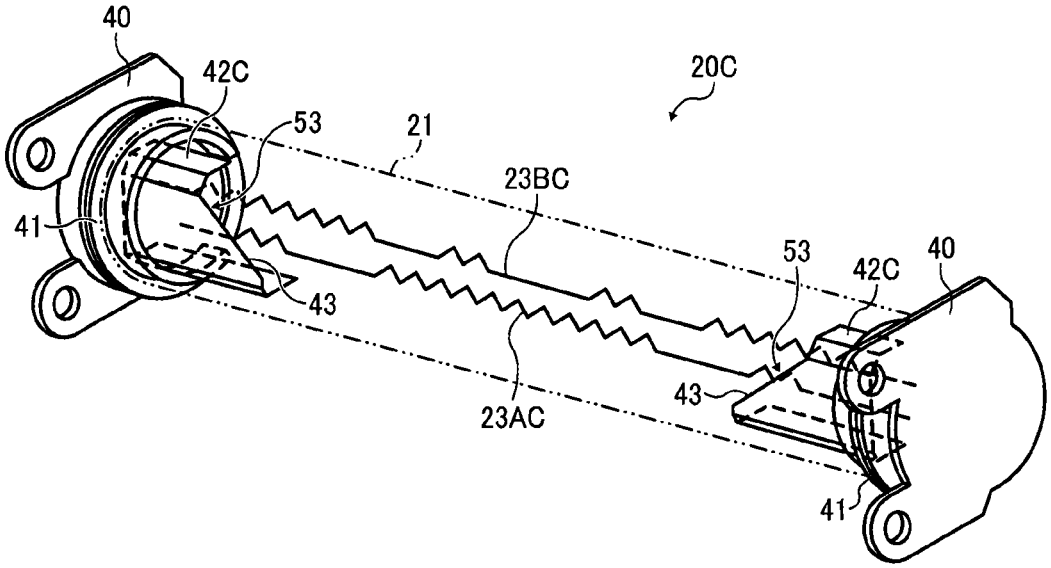
FIG. 3 RELATED ART
FIG. 3 is a partial perspective view of a comparative fixing device.

FIG. 3 is a partial perspective view of the second comparative fixing device 20C. As shown in FIG. 3, a pair of belt holders 40 is inserted into both lateral ends of the fixing belt 21 in the axial direction thereof, respectively, to rotatably support the fixing belt 21. The belt holders 40 are fixedly secured to side plates of the second comparative fixing device 20C, respectively. FIG. 3 omits the nip formation pad 24, the stay 25, the reflector 26, and the like illustrated in FIG. 2.

A slip ring 41 is interposed between a lateral edge face of the fixing belt 21 and an opposed face of the belt holder 40 disposed opposite the lateral edge face of the fixing belt 21, thus serving as a protector that protects each lateral end of the fixing belt 21 in the axial direction thereof. Accordingly, even if the fixing belt 21 is skewed in the axial direction thereof, the slip ring 41 prevents the lateral end of the fixing belt 21 from coming into direct contact with the belt holder 40, preventing abrasion and breakage of the lateral end of the fixing belt 21.

The slip ring 41 is loosely fitted onto an outer circumferential surface of the belt holder 40. Hence, as the lateral end of the fixing belt 21 contacts the slip ring 41, the slip ring 41 is rotatable in accordance with rotation of the fixing belt 21. Alternatively, the slip ring 41 may not be rotatable in accordance with rotation of the fixing belt 21 and therefore may be stationary. For example, the slip ring 41 is made of heat resistant super engineering plastic such as PEEK, PPS, PAI, and PTFE.

A heat shield 42C is disposed opposite each lateral end of the fixing belt 21 in the axial direction thereof to shield the fixing belt 21 from light or heat radiated from halogen heaters 23AC and 23BC. Each heat shield 42C is interposed between the halogen heaters 23AC and 23BC and the fixing belt 21. A part of each heat shield 42C is inserted into the belt holder 40 and interposed between the halogen heaters 23AC and 23BC and the belt holder 40.

Figure 4:
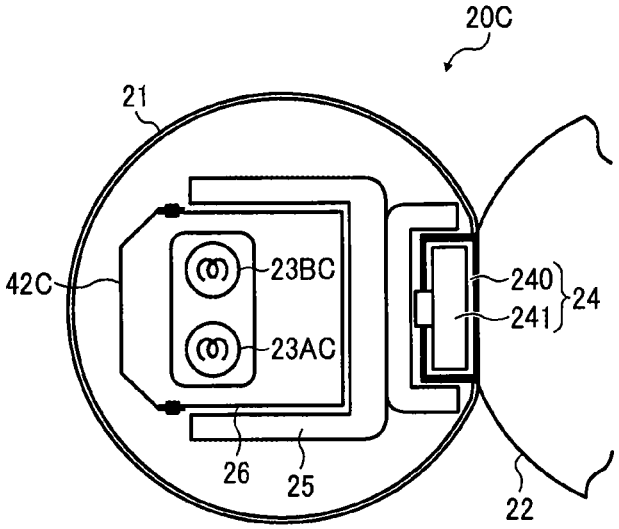
FIG. 4 RELATED ART
FIG. 4 is a partial vertical sectional view of the comparative fixing device shown in FIG. 3.
Figure 5:
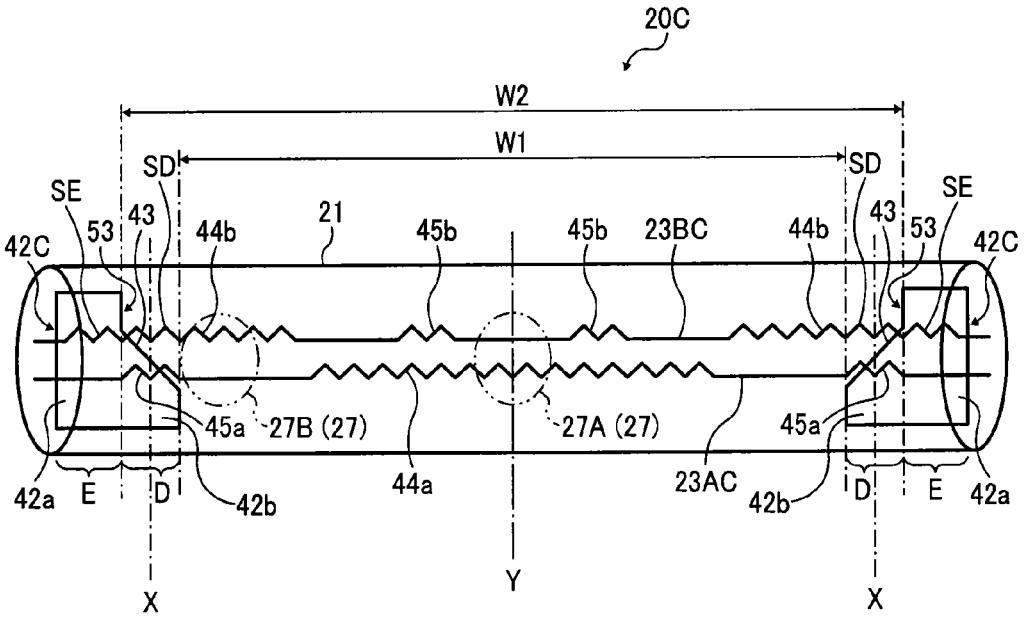
FIG. 5 is a sectional side view of the comparative fixing device shown in FIG. 3.

FIG. 4 is a partial vertical sectional view of the second comparative fixing device 20C. As shown in FIG. 4, the heat shield 42C is disposed opposite the stay 25 via the halogen heaters 23AC and 23BC and is fixedly secured to the reflector 26. FIG. 5 is a sectional side view of the second comparative fixing device 20C. The lower halogen heater 23AC in FIG. 5 is hereinafter referred to as a first halogen heater 23AC. The upper halogen heater 23BC in FIG. 5 is hereinafter referred to as a second halogen heater 23BC. The first halogen heater 23AC is different from the second halogen heater 23BC in the position of a heat generator or a light emitter incorporated therein. For example, the first halogen heater 23AC includes a major heat generator 44*a* disposed at a predetermined center span of the first halogen heater 23AC in a longitudinal direction thereof and a minor heat generator 45*a* disposed at each lateral end span of the first halogen heater 23AC in the longitudinal direction thereof. The major heat generator 44*a* spans symmetrically from a center of the first halogen heater 23AC in the longitudinal direction thereof and has a width in a range of from 200 mm to 220 mm. Each minor heat generator 45*a* is disposed outboard from the major heat generator 44*a* in the longitudinal direction of the first halogen heater 23AC.

Unlike the first halogen heater 23AC, the second halogen heater 23BC includes two major heat generators 44*b* and two minor heat generators 45*b*. The two minor heat generators 45*b* span symmetrically from a center of the second halogen heater 23BC in the longitudinal direction thereof and has a width in a range of from 200 mm to 220 mm. Each major heat generator 44*b* is disposed outboard from each minor heat generator 45*b* in the longitudinal direction of the second halogen heater 23BC. An outboard edge of each major heat generator 44*b* is distanced symmetrically from the center of the second halogen heater 23BC in the longitudinal direction thereof and defines a width in a range of from 300 mm to 330 mm.

The major heat generator 44*a* of the first halogen heater 23AC and the major heat generators 44*b* of the second halogen heater 23BC serve as a main heat generator that emits light and generates heat mainly. The minor heat generators 45*a* of the first halogen heater 23AC and the minor heat generators 45*b* of the second halogen heater 23BC are provided to support a filament of each of the first halogen heater 23AC and the second halogen heater 23BC relative to a glass tube and therefore serve as a sub heat generator that emits light and generates heat slightly. Each of the minor heat generators 45*a* and 45*b* has a light emission span that is equivalent to 5 percent or smaller of the total length of each of the first halogen heater 23AC and the second halogen heater 23BC in the longitudinal direction thereof.

As shown in FIG. 5, the second comparative fixing device 20C includes two thermopiles 27 that detect the temperature of the fixing belt 21. One of the thermopiles 27, that is, a center thermopile 27A, is disposed opposite a center span of the fixing belt 21 in the axial direction thereof. Another one of the thermopiles 27, that is, a lateral end thermopile 27B, is disposed opposite a lateral end span of the fixing belt 21 in the axial direction thereof. The center thermopile 27A detects the temperature of the center span of the fixing belt 21 in the axial direction thereof that is disposed opposite the major heat generator 44*a* of the first halogen heater 23AC. The lateral end thermopile 27B detects the temperature of the lateral end span of the fixing belt 21 in the axial direction thereof that is disposed opposite the major heat generator 44*b* of the second halogen heater 23BC.

A regular size sheet conveyance span W1 in the axial direction of the fixing belt 21 is a maximum conveyance span or a decreased conveyance span of the fixing belt 21 where a regular size sheet, that is, an A3 size sheet in portrait orientation or an A4 size sheet in landscape orientation, is conveyed over the fixing belt 21. In other words, the regular size sheet conveyance span W1 is the maximum conveyance span or the decreased conveyance span of the fixing belt 21 where sheets P of regular sizes frequently used, such as the A3 size sheet, are conveyed over the fixing belt 21.

A large sheet conveyance span W2 in the axial direction of the fixing belt 21 is a large conveyance span or an increased conveyance span of the fixing belt 21 where a large sheet P greater than the A3 size sheet in portrait orientation or the A4 size sheet in landscape orientation in the axial direction of the fixing belt 21, such as a 12-inch to 13-inch sheet and an A3 extension size sheet, is conveyed over the fixing belt 21.

The regular size sheet conveyance span W1 defining the maximum conveyance span or the decreased conveyance span is centered on the fixing belt 21 in the axial direction thereof and has a width of 297 mm. The large sheet conveyance span W2 defining the large conveyance span or the increased conveyance span is centered on the fixing belt 21 in the axial direction thereof. The large sheet conveyance span W2 has a width of 304.8 mm for the 12-inch sheet, a width of 330.2 mm for the 13-inch sheet, and a width of 332.9 mm for the A3 extension size sheet.

Each heat shield 42C is disposed outboard from the regular size sheet conveyance span W1 defining the maximum conveyance span or the decreased conveyance span in the axial direction of the fixing belt 21. For example, each heat shield 42C shields the fixing belt 21 from an outboard heat generation portion of the second halogen heater 23BC that is disposed outboard from the regular size sheet conveyance span W1 in the axial direction of the fixing belt 21, that is, a part of the major heat generator 44*b* of the second halogen heater 23BC that is outboard from the regular size sheet conveyance span W1 in the axial direction of the fixing belt 21.

The heat shield 42C includes an aperture 53 disposed opposite each inboard span D disposed inboard from each lateral edge of the large sheet conveyance span W2 in the axial direction of the fixing belt 21. The aperture 53 extends from each lateral end of the fixing belt 21 toward a center of the fixing belt 21 in the axial direction thereof. The aperture 53 created at a part of the heat shield 42C allows the heat shield 42C to be constructed of an outboard shield portion 42*a* spanning an outboard span E and an inboard shield portion 42*b* spanning the inboard span D. The outboard span E is outboard from the large sheet conveyance span W2 in the axial direction of the fixing belt 21. The area of the inboard shield portion 42*b* defined by the aperture 53 and disposed opposite the inner circumferential surface of the fixing belt 21 is smaller than the area of the outboard shield portion 42*a* disposed opposite the inner circumferential surface of the fixing belt 21.

The inboard shield portion 42*b* defined by the aperture 53 shields the fixing belt 21 from the first halogen heater 23AC and the second halogen heater 23BC in a decreased area compared to the outboard shield portion 42*a*. Accordingly, a part of the major heat generator 44*b* of the second halogen heater 23BC that spans the inboard span D is exposed to the fixing belt 21.

Figure 6:
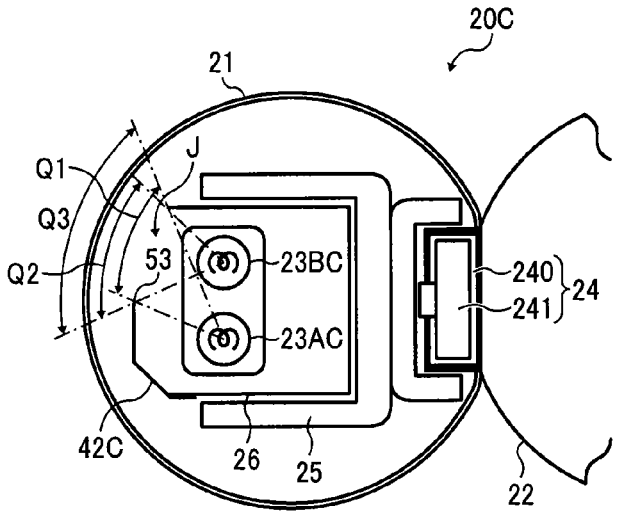
FIG. 6 is a partial vertical sectional view of the comparative fixing device shown in FIG. 4 illustrating an opening incorporated therein.

As shown in FIG. 4, the outboard shield portion 42*a* spanning the outboard span E and the reflector 26 surround the first halogen heater 23AC and the second halogen heater 23BC in the circumferential direction of the fixing belt 21. Conversely, as shown in FIG. 6, the aperture 53 spanning the inboard span D produces an opening J. FIG. 6 is a partial vertical sectional view of the second comparative fixing device 20C illustrating the opening J. Light emitted from the first halogen heater 23AC and the second halogen heater 23BC irradiates the fixing belt 21 through the opening J defined by the aperture 53 spanning the inboard span D.

As shown in FIG. 5, the inboard shield portion 42*b* includes a slope 43 defining the aperture 53 and being tilted relative to the axial direction of the fixing belt 21. As shown in FIG. 5, the slope 43 is tilted downward from a lateral edge of the large sheet conveyance span W2 to a lateral edge of the regular size sheet conveyance span W1 in the axial direction of the fixing belt 21. The slope 43 gradually decreases the area of the inboard shield portion 42*b* disposed opposite the inner circumferential surface of the fixing belt 21, that is, a shield area of the fixing belt 21 shielded by the inboard shield portion 42*b*, toward the regular size sheet conveyance span W1 or the center of the fixing belt 21 in the axial direction thereof.

As shown in FIG. 6, the aperture 53 produces a direct irradiation span Q3 spanning in the circumferential direction of the fixing belt 21 in cross-section. Light emitted from a center, that is, an axis, of each of the first halogen heater 23AC and the second halogen heater 23BC in cross-section directly irradiates the direct irradiation span Q3 of the fixing belt 21 not through the reflector 26 and the like.

Since the two halogen heaters, that is, the first halogen heater 23AC and the second halogen heater 23BC, heat the fixing belt 21, light emitted by the first halogen heater 23AC directly irradiates a direct irradiation span Q1 of the fixing belt 21 through the aperture 53 and light emitted by the second halogen heater 23BC directly irradiates a direct irradiation span Q2 of the fixing belt 21 through the aperture 53. The direct irradiation spans Q1 and Q2 are combined into the direct irradiation span Q3.

Since the aperture 53 defines the slope 43 depicted in FIG. 5, the direct irradiation span Q3 changes in the axial direction of the fixing belt 21 according to inclination of the slope 43. For example, the direct irradiation span Q3 gradually increases toward the center of the fixing belt 21 in the axial direction thereof, increasing an amount of light that irradiates the fixing belt 21.

A description is provided of a configuration and advantages of the heat shield 42C as sheets P of various sizes are conveyed through the fixing nip N.

When the A3 size sheet in portrait orientation or the A4 size sheet in landscape orientation is conveyed through the second comparative fixing device 20C, both the first halogen heater 23AC and the second halogen heater 23BC are powered on. The first halogen heater 23AC and the second halogen heater 23BC produce the light emission span, that is, the length of the light emitter in the axial direction of the fixing belt 21, in a range of from 300 mm to 330 mm that is greater than the width in the axial direction of the fixing belt 21 of 297 mm of the A3 size sheet in portrait orientation or the A4 size sheet in landscape orientation.

Generally, the light intensity of the light emitter of halogen heaters decreases at a lateral end of the light emitter in a longitudinal direction of the halogen heaters parallel to the axial direction of the fixing belt 21. Accordingly, if a light emission span is equivalent to a conveyance span of the fixing belt 21 where a sheet P is conveyed, a temperature distribution of each lateral end of the conveyance span of the fixing belt 21 may decrease compared to a temperature distribution of a center of the conveyance span of the fixing belt 21 when warm-up of the fixing belt 21 has finished or when conveyance of a sheet P to the fixing belt 21 starts.

To address this circumstance, the light emitter of the halogen heaters is designed to achieve the light emission span greater than the conveyance span of the fixing belt 21 in the axial direction thereof so that a part of the light emission span that achieves a uniform light intensity spans the conveyance span of the fixing belt 21 in the axial direction thereof. Thus, even when an initial sheet P of a print job is conveyed over the fixing belt 21, each lateral end of the light emitter in the axial direction of the fixing belt 21 attains a fixing property of heating the fixing belt 21 to a desired fixing temperature at which a toner image T is fixed on the sheet P properly.

As shown in FIG. 5, a part of each major heat generator 44*b* of the second halogen heater 23BC that spans the inboard span D is a supplementary heat generator SD that suppresses temperature decrease in each lateral end of the regular size sheet conveyance span W1 where the regular size sheet P is conveyed. A part of each major heat generator 44*b* of the second halogen heater 23BC that spans the outboard span E is a supplementary heat generator SE that suppresses temperature decrease in each lateral end of the large sheet conveyance span W2 where the large sheet P is conveyed.

However, if the light emitter is elongated to span an outboard span disposed outboard from the regular size sheet conveyance span W1 in the axial direction of the fixing belt 21, when the A3 size sheets in portrait orientation or the A4 size sheets in landscape orientation are conveyed continuously, even if the light emitter generates a decreased amount of heat at a part of the light emitter that is situated outboard from the regular size sheet conveyance span W1 in the axial direction of the fixing belt 21, the A3 size sheets or the A4 size sheets do not draw heat from a part of the fixing belt 21 that is disposed opposite the outboard span disposed outboard from the regular size sheet conveyance span W1 in the axial direction of the fixing belt 21, resulting in overheating of the fixing belt 21 to temperatures higher than a heat resistant temperature of the fixing belt 21.

To address this circumstance, the heat shield 42C is disposed outboard from the regular size sheet conveyance span W1 in the axial direction of the fixing belt 21 to shield the fixing belt 21 from light emitted from the elongated light emitter of the first halogen heater 23AC and the second halogen heater 23BC. Accordingly, even when the initial sheet P of the print job is conveyed over the fixing belt 21, each lateral end of the initial sheet P in the axial direction of the fixing belt 21 is heated sufficiently. Additionally, even when the A3 size sheets or the A4 size sheets are conveyed continuously, overheating is suppressed at each outboard span of the fixing belt 21 that is outboard from the regular size sheet conveyance span W1 in the axial direction of the fixing belt 21.

As described above, the first halogen heater 23AC and the second halogen heater 23BC include the minor heat generators 45*a* and 45*b*, respectively, each of which supports the filament relative to the glass tube. However, heat generated by the minor heat generators 45*a* and 45*b* may vary a temperature distribution or overheat the fixing belt 21. To address this circumstance, as shown in FIG. 5, the heat shield 42C is interposed between the fixing belt 21 and each minor heat generator 45*a* disposed at each lateral end of the first halogen heater 23AC in the axial direction of the fixing belt 21. Thus, the heat shield 42C shields the fixing belt 21 from light emitted from each minor heat generator 45*a*, suppressing or preventing variation in the temperature distribution and overheating of the fixing belt 21.

Figure 7:
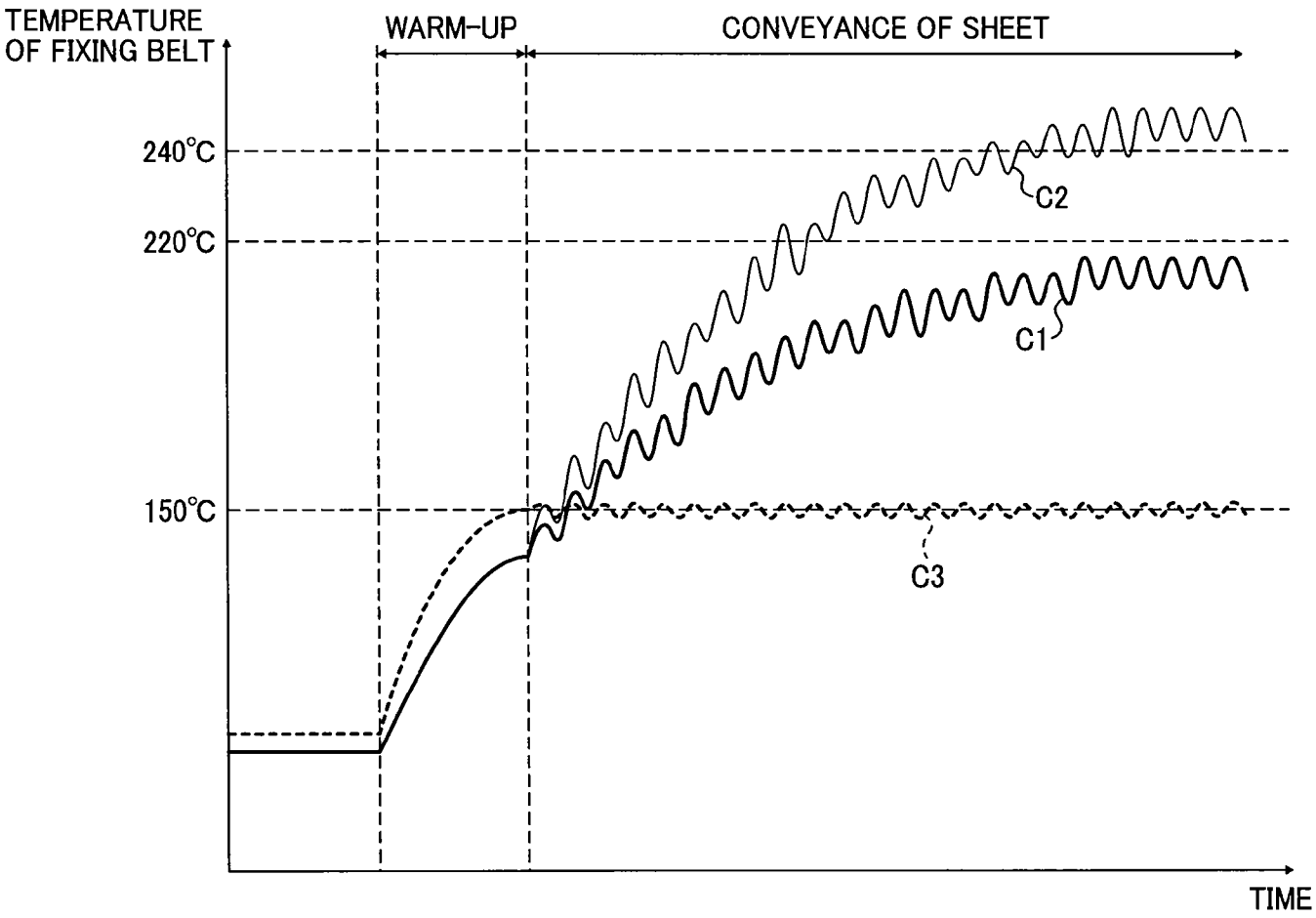
FIG. 7 is a graph showing a relation between time and temperature of a fixing belt incorporated in the comparative fixing device shown in FIG. 3.

FIG. 7 is a graph showing a relation between time and temperature of the fixing belt 21 with and without the heat shield 42C. In FIG. 7, a curve C1 in the bold solid line represents change in temperature at a position X depicted in FIG. 5 disposed at each lateral end of the fixing belt 21 in the axial direction thereof and shielded by the heat shield 42C. A curve C2 in the narrow solid line represents change in temperature at the position X not shielded by the heat shield 42C. A curve C3 in the dotted line represents change in temperature at a position Y depicted in FIG. 5 disposed at the center of the fixing belt 21 in the axial direction thereof.

The curve C1 shows that the heat shield 42C suppresses temperature increase of each outboard span of the fixing belt 21 that is outboard from the regular size sheet conveyance span W1 where the A3 size sheet in portrait orientation or the A4 size sheet in landscape orientation is conveyed effectively compared to temperature increase of each outboard span of the fixing belt 21 not shielded by the heat shield 42C shown by the curve C2. The curve C2 shows that the fixing belt 21 suffers from temperature increase above the heat resistant temperature of 220 degrees centigrade when the fixing belt 21 is not shielded by the heat shield 42C. Conversely, the curve C1 shows that the temperature of the fixing belt 21 is suppressed below the heat resistant temperature when the fixing belt 21 is shielded by the heat shield 42C.

As the large sheet P (e.g., the 13-inch sheet) is conveyed over the fixing belt 21, both the first halogen heater 23AC and the second halogen heater 23BC are powered on like when the A3 size sheet in portrait orientation or the A4 size sheet in landscape orientation is conveyed. As shown in FIG. 5, a part of the heat shield 42C, that is, each inboard shield portion 42*b* spanning the inboard span D, overlaps each lateral end span of the large sheet conveyance span W2 in the axial direction of the fixing belt 21. Accordingly, each inboard shield portion 42*b* shields the fixing belt 21 in each lateral end span of the large sheet conveyance span W2 from light emitted from the first halogen heater 23AC and the second halogen heater 23BC. Consequently, when the large sheet P is conveyed over the fixing belt 21, each lateral end of the fixing belt 21 in the axial direction thereof may suffer from shortage of heat, resulting in fixing failure at each lateral end of the large sheet P in the axial direction of the fixing belt 21.

To address this circumstance, the heat shield 42C includes the aperture 53 disposed opposite each lateral end span of the large sheet conveyance span W2 of the fixing belt 21 to increase an amount of light irradiating the fixing belt 21 so as to reduce fixing failure at each lateral end of the large sheet P in the axial direction of the fixing belt 21. However, temperature control may not be directed solely to each lateral end of the large sheet P in the axial direction of the fixing belt 21. For example, a fixing property of being heated to the desired fixing temperature may be controlled insufficiently for each lateral end of the large sheet P in the axial direction of the fixing belt 21 because the fixing property is adversely affected by the thickness of the large sheet P and the like.

A description is provided of a configuration of the fixing device 20 according to this exemplary embodiment to address the disadvantageous circumstances described above of the first comparative fixing device and the second comparative fixing device 20C.

Figure 8:
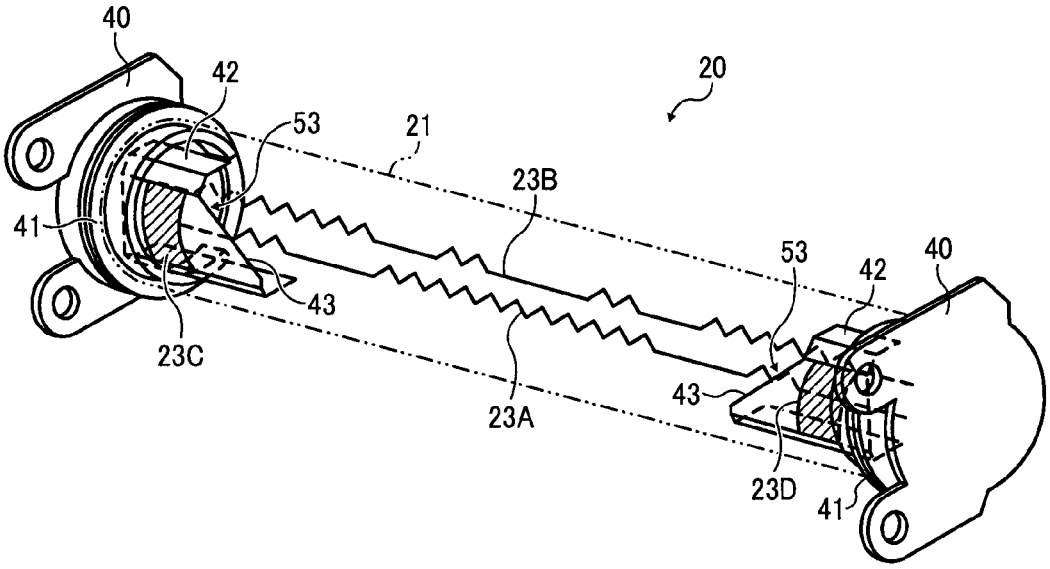
FIG. 8 is a partial perspective view of the fixing device shown in FIG. 2.
Figure 9:
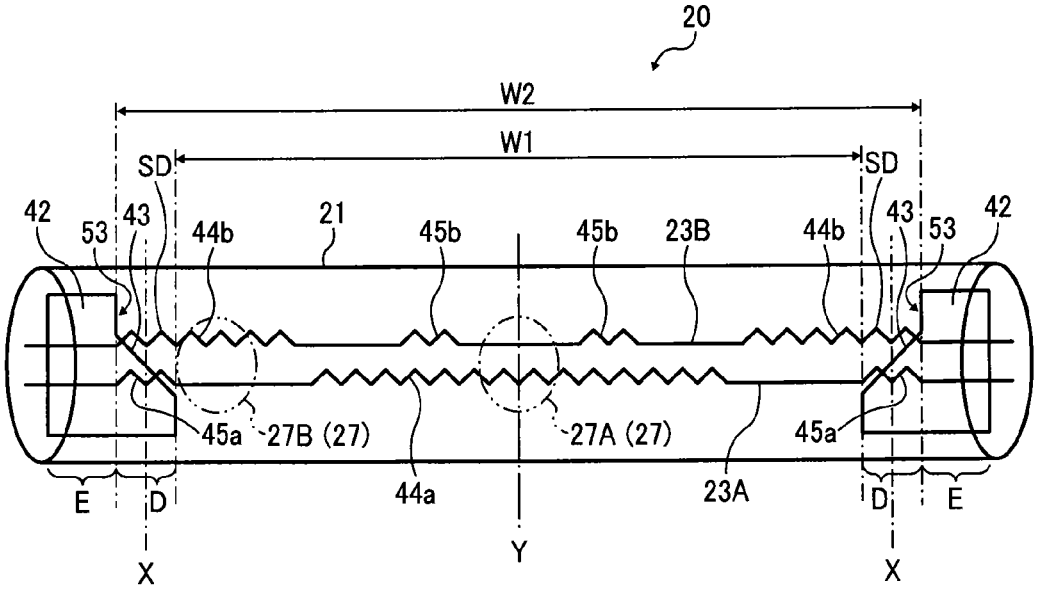
FIG. 9 is a sectional side view of the fixing device shown in FIG. 8.

FIG. 8 is a partial perspective view of the fixing device 20. FIG. 9 is a sectional side view of the fixing device 20. A description of a construction and a configuration of the fixing device 20 that are equivalent to the construction and the configuration of the second comparative fixing device 20C mentioned above is omitted.

As shown in FIG. 8, laminated heat generators 23C and 23D indicated by hatching serve as a secondary heater or a secondary heat source that heats the fixing belt 21. The laminated heat generators 23C and 23D are mounted on or fixedly secured to an opposed face of the heat shield 42 that is disposed opposite the inner circumferential surface of the fixing belt 21 and curved along the opposed face of the heat shield 42. The laminated heat generators 23C and 23D are disposed outboard from the regular size sheet conveyance span W1 depicted in FIG. 9 in the axial direction of the fixing belt 21. It is to be noted that FIG. 2 omits illustration of the heat shield 42.

When the regular size sheet P, that is, the A3 size sheet in portrait orientation or the A4 size sheet in landscape orientation, is conveyed through the fixing device 20, the first halogen heater 23A and the second halogen heater 23B are powered on and the laminated heat generators 23C and 23D are powered off, preventing overheating of the fixing belt 21 in each outboard span outboard from the regular size sheet conveyance span W1 in the axial direction of the fixing belt 21 and attaining the fixing property of being heated to the desired fixing temperature for each lateral end of the regular size sheet P in the axial direction of the fixing belt 21 sufficiently.

When the large sheet P, that is, the 13-inch sheet or the like, is conveyed through the fixing device 20, the first halogen heater 23A and the second halogen heater 23B are powered on and the laminated heat generators 23C and 23D are also powered on, attaining the fixing property of being heated to the desired fixing temperature for each lateral end of the large sheet P in the axial direction of the fixing belt 21 sufficiently.

Since the laminated heat generators 23C and 23D attain the fixing property of being heated to the desired fixing temperature for each lateral end of the large sheet P spanning the large sheet conveyance span W2 depicted in FIG. 9, it is not necessary to elongate each major heat generator 44*b* of the second halogen heater 23B that is configured to heat each lateral end of the fixing belt 21 mainly to each lateral edge of the second halogen heater 23B in the axial direction of the fixing belt 21.

As shown in FIG. 9, the second halogen heater 23B includes a shortened filament, serving as a light emitter, shortened by the outboard span E compared to the second halogen heater 23BC of the second comparative fixing device 20C shown in FIG. 5. The outboard span E is outboard from the large sheet conveyance span W2 and the aperture 53 in the axial direction of the fixing belt 21. In other words, each of the laminated heat generators 23C and 23D heats the outboard span E of the fixing belt 21 instead of the supplementary heat generator SE of the second comparative fixing device 20C depicted in FIG. 5. Accordingly, the length of the light emitter of the second halogen heater 23B is merely great enough to attain the fixing property of being heated to the desired fixing temperature for each lateral end of the regular size sheet P in the axial direction of the fixing belt 21 such as the A3 size sheet.

Figure 10:
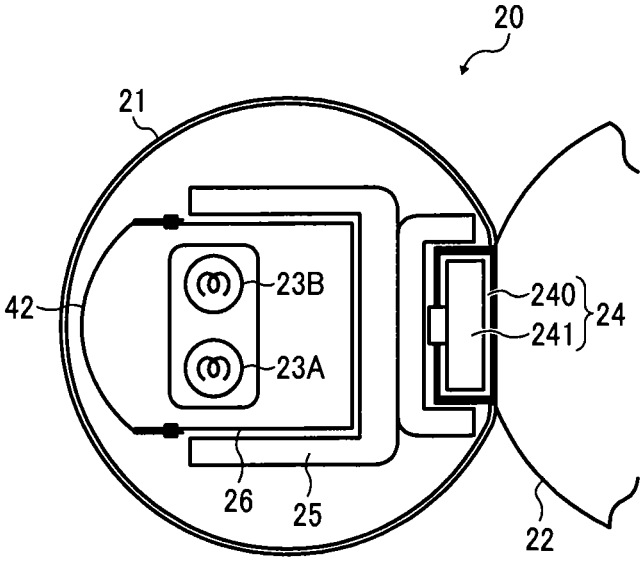
FIG. 10 is a partial vertical sectional view of the fixing device shown in FIG. 2.

FIG. 10 is a partial vertical sectional view of the fixing device 20. As shown in FIG. 10, the heat shield 42 may be disposed closer to the fixing belt 21 than the heat shield 42C of the second comparative fixing device 20C depicted in FIG. 4 and contoured along the inner circumferential surface of the fixing belt 21 to shorten the distance between the laminated heat generators 23C and 23D depicted in FIG. 8 and the fixing belt 21 and therefore facilitate conduction of heat from the laminated heat generators 23C and 23D to the fixing belt 21.

Figure 11:
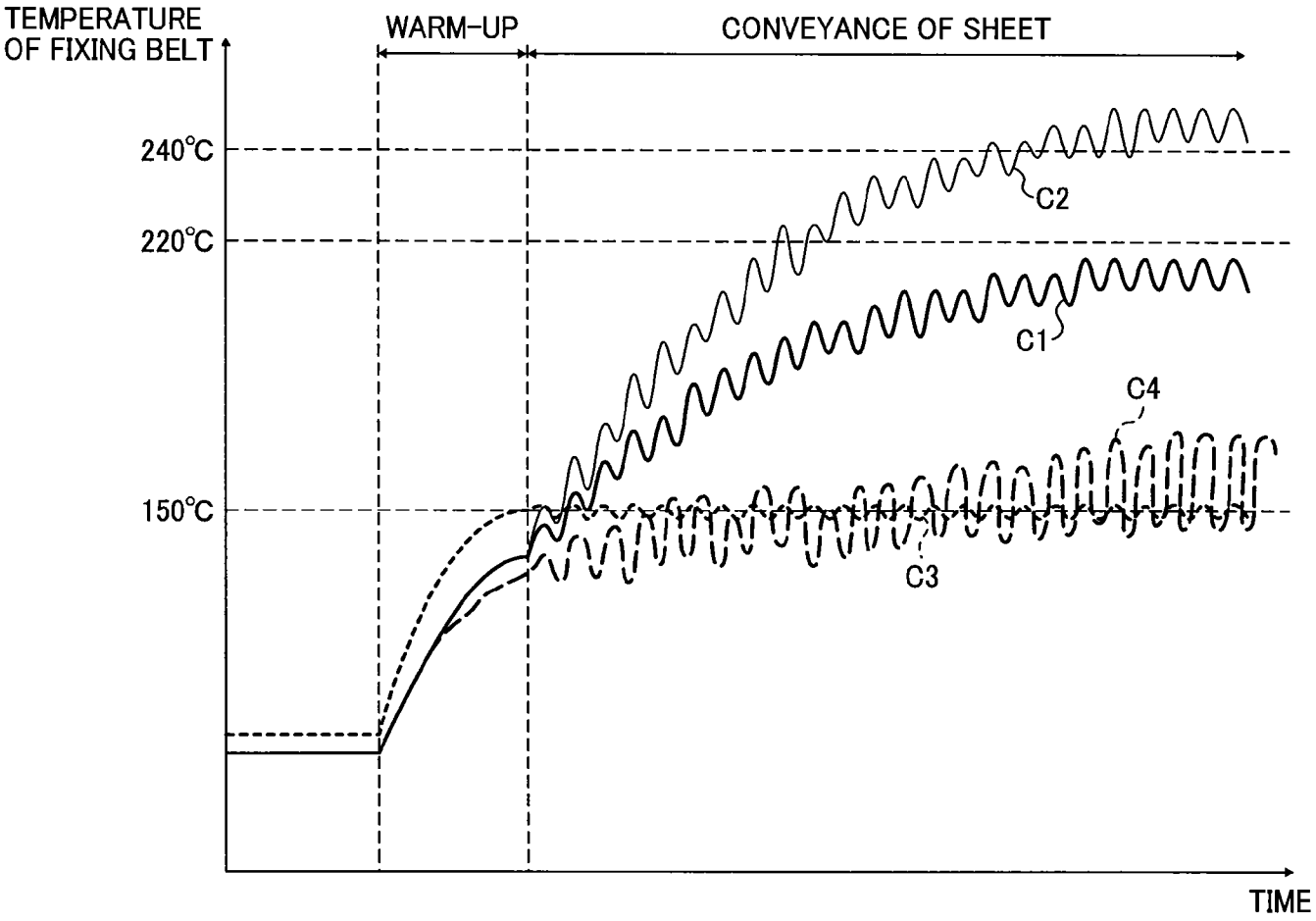
FIG. 11 is a graph showing a relation between time and temperature of the fixing belt incorporated in the fixing device shown in FIG. 8.

FIG. 11 is a graph showing a relation between time and temperature of the fixing belt 21 of the fixing device 20 according to the first exemplary embodiment under a condition identical to the condition shown in FIG. 7. In FIG. 11, the curve C1 in the bold solid line represents change in temperature at the position X depicted in FIG. 5 disposed at each lateral end of the fixing belt 21 in the axial direction thereof and shielded by the heat shield 42C with the second comparative fixing device 20C not incorporating the laminated heat generators 23C and 23D serving as a secondary heater. The curve C2 in the narrow solid line represents change in temperature at the position X depicted in FIG. 5 disposed at each lateral end of the fixing belt 21 in the axial direction thereof and not shielded by the heat shield 42C with the second comparative fixing device 20C not incorporating the laminated heat generators 23C and 23D. A curve C4 in the bold dotted line and having an increased amplitude represents change in temperature at the position X depicted in FIG. 9 disposed at each lateral end of the fixing belt 21 in the axial direction thereof with the fixing device 20 according to this exemplary embodiment. The curve C3 in the dotted line represents change in temperature at the position Y depicted in FIG. 9 disposed at the center of the fixing belt 21 in the axial direction thereof with the fixing device 20 according to this exemplary embodiment.

The curves C3 and C4 show that the laminated heat generators 23C and 23D suppress temperature increase of each outboard span of the fixing belt 21 that is outboard from the regular size sheet conveyance span W1 where the A3 size sheet in portrait orientation or the A4 size sheet in landscape orientation is conveyed compared to temperature increase of each outboard span of the fixing belt 21 shielded by the heat shield 42C with the second comparative fixing device 20C not incorporating the laminated heat generators 23C and 23D.

A description is provided of a construction of a fixing device 20S according to a second exemplary embodiment.

Figure 12:
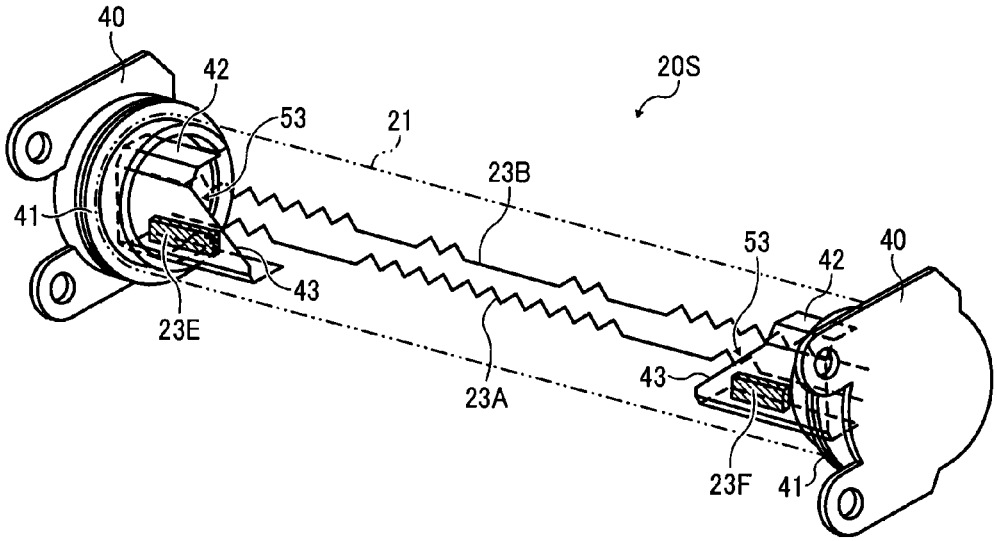
FIG. 12 is a partial perspective view of a fixing device according to a second exemplary embodiment of the present disclosure.

FIG. 12 is a partial perspective view of the fixing device 20S. The fixing device 20 according to the first exemplary embodiment shown in FIG. 8 includes the laminated heat generators 23C and 23D serving as a secondary heater that heats the fixing belt 21. Alternatively, the fixing device 20S includes stationary heat generators 23E and 23F as shown in FIG. 12. When the regular size sheet P, that is, the A3 size sheet in portrait orientation or the A4 size sheet in landscape orientation, is conveyed through the fixing device 20S, the first halogen heater 23A and the second halogen heater 23B are powered on and the stationary heat generators 23E and 23F are powered off, preventing overheating of the fixing belt 21 in each outboard span outboard from the regular size sheet conveyance span W1 depicted in FIG. 9 in the axial direction of the fixing belt 21 and attaining the fixing property of being heated to the desired fixing temperature for the regular size sheet P sufficiently. When the large sheet P, that is, the 13-inch sheet or the like, is conveyed through the fixing device 20S, the first halogen heater 23A and the second halogen heater 23B are powered on and the stationary heat generators 23E and 23F are also powered on, attaining the fixing property of being heated to the desired fixing temperature for the large sheet P sufficiently.

With reference to FIGS. 13A, 13B, 14, and 15, a description is provided of a configuration of laminated heat generators 23CS and 23CT according to a third exemplary embodiment.

Figure 13A:
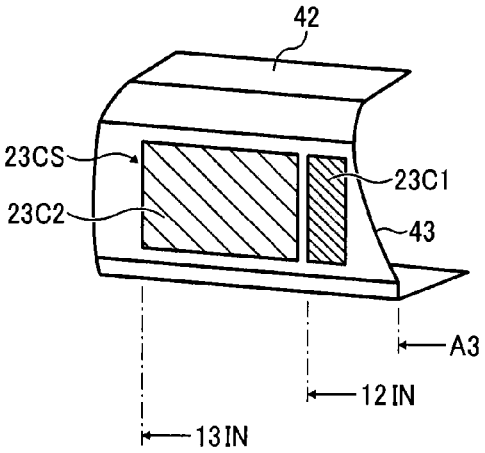
FIG. 13A is a perspective view of a laminated heat generator according to a third exemplary embodiment of the present disclosure that is incorporated in the fixing device shown in FIG. 2.
Figure 13B:
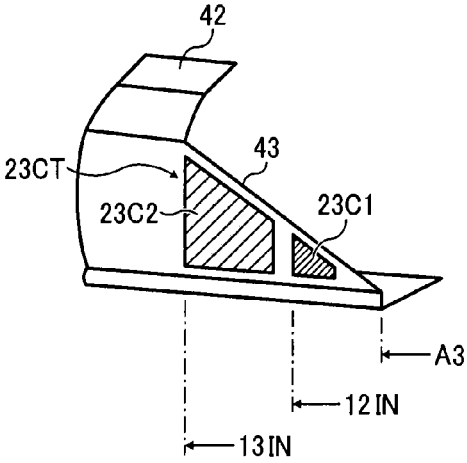
FIG. 13B is a perspective view of a laminated heat generator as a variation of the laminated heat generator shown in FIG. 13A.
Figure 14:
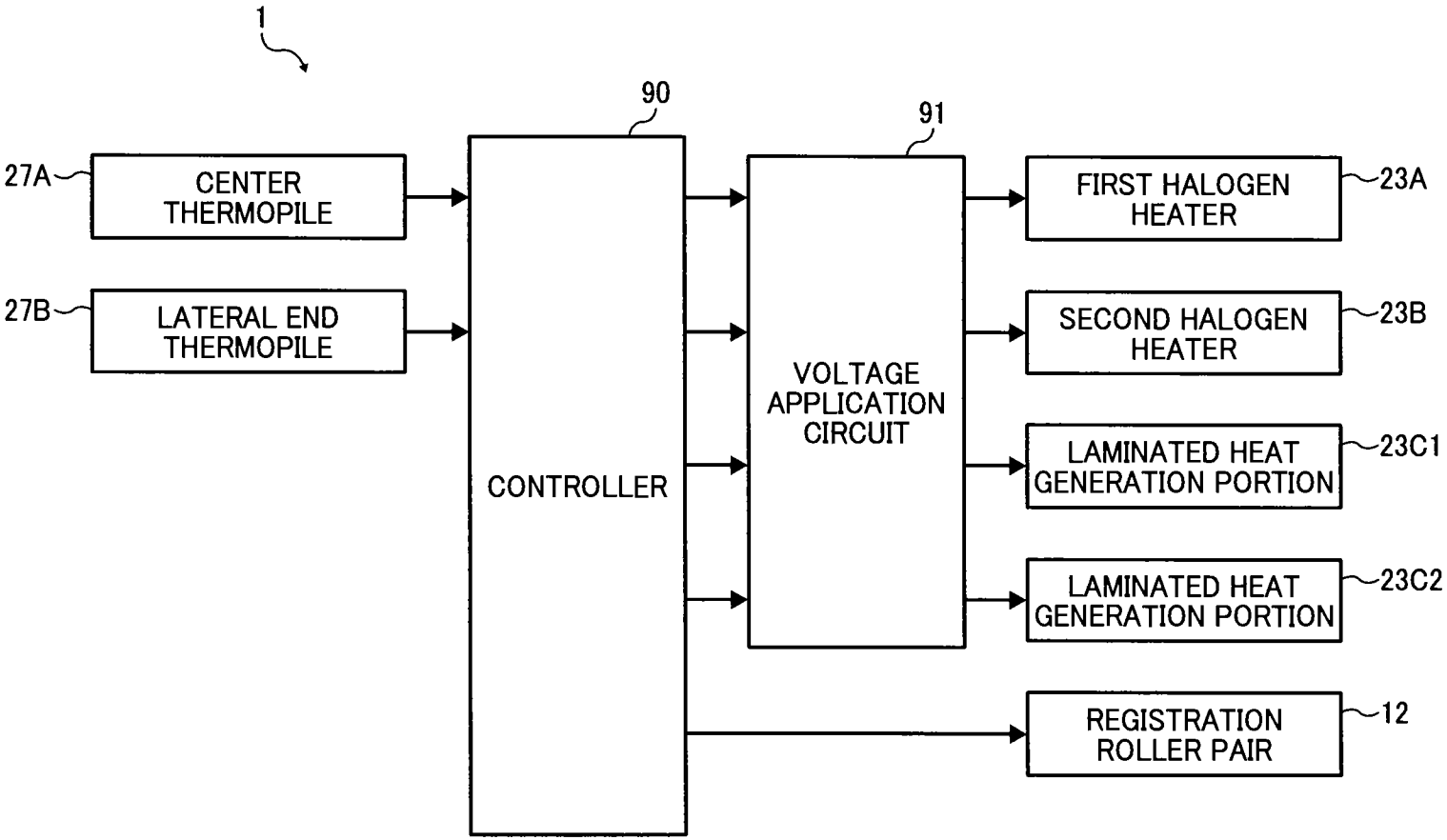
FIG. 14 is a block diagram of the image forming apparatus shown in FIG. 1.

FIG. 13A is a perspective view of the laminated heat generator 23CS. FIG. 13B is a perspective view of the laminated heat generator 23CT. FIG. 14 is a block diagram of the image forming apparatus 1 incorporating the fixing device 20 or 20S. It is to be noted that the controller 90 may be situated inside the fixing device 20, the fixing device 20S, or the image forming apparatus 1 depicted in FIG. 1.

As shown in FIGS. 13A and 13B, each of the laminated heat generators 23CS and 23CT mounted on the heat shield 42 is constructed of a plurality of laminated heat generation portions 23C1 and 23C2 isolated from each other in a width direction of the sheet P parallel to the axial direction of the fixing belt 21.

FIG. 13A illustrates the laminated heat generator 23CS constructed of the laminated heat generation portions 23C1 and 23C2 produced by dividing the laminated heat generator 23C depicted in FIG. 8. The laminated heat generation portion 23C1 serving as a first heat generation portion is isolated from the laminated heat generation portion 23C2 serving as a second heat generation portion with an interval therebetween in the axial direction of the fixing belt 21. A voltage application circuit 91 energizes the laminated heat generation portion 23C1 separately from the laminated heat generation portion 23C2. Similarly, the laminated heat generator 23D depicted in FIG. 8 is divided into the laminated heat generation portions 23C1 and 23C2 energized separately from each other.

The laminated heat generator 23CS is immune from a temperature decrease property that may appear at each lateral end of the light emitter of the halogen heater. Hence, a lateral edge of each of the laminated heat generation portions 23C1 and 23C2 in the axial direction of the fixing belt 21 substantially corresponds to a lateral edge of the conveyance span of the sheet P in the axial direction of the fixing belt 21. For example, the lateral edge of the laminated heat generation portion 23C2 in the axial direction of the fixing belt 21 corresponds to the lateral edge of a conveyance span 13IN of the 13-inch sheet in the axial direction of the fixing belt 21. The lateral edge of the laminated heat generation portion 23C1 in the axial direction of the fixing belt 21 corresponds to the lateral edge of a conveyance span 12IN of the 12-inch sheet in the axial direction of the fixing belt 21. The laminated heat generation portions 23C1 and 23C2 are outboard from a conveyance span A3 of the A3 size sheet in the axial direction of the fixing belt 21.

When the A3 size sheet in portrait orientation or the A4 size sheet in landscape orientation is conveyed over the fixing belt 21, both the laminated heat generation portions 23C1 and 23C2 are powered off and the heat shield 42 shields the fixing belt 21 from the first halogen heater 23A and the second halogen heater 23B, suppressing overheating of each lateral end of the fixing belt 21 in the axial direction thereof. When the 12-inch sheet is conveyed over the fixing belt 21, the laminated heat generation portion 23C1 is powered on and the laminated heat generation portion 23C2 is powered off, thus attaining the fixing property of heating each lateral end of the 12-inch sheet in the axial direction of the fixing belt 21 sufficiently. Additionally, the laminated heat generation portion 23C2 does not heat a non-conveyance span of the fixing belt 21 where the 12-inch sheet is not conveyed unnecessarily, thus preventing overheating of the non-conveyance span of the fixing belt 21. Similarly, when the 13-inch sheet is conveyed over the fixing belt 21, both the laminated heat generation portions 23C1 and 23C2 are powered on, thus attaining the fixing property of heating each lateral end of the 13-inch sheet in the axial direction of the fixing belt 21 sufficiently while preventing unnecessary heating and resultant overheating of a non-conveyance span of the fixing belt 21 where the 13-inch sheet is not conveyed.

As shown in FIG. 13A, the slope 43 of the heat shield 42 does not span to a lateral edge of a maximum conveyance span of a maximum sheet, that is, the lateral edge of the conveyance span 13IN of the 13-inch sheet in the axial direction of the fixing belt 21. The slope 43 is sharply tilted downward toward the center of the fixing belt 21 in the axial direction thereof. Alternatively, as shown in FIG. 13B, the slope 43 of the heat shield 42 may span to the lateral edge of the maximum conveyance span of the maximum sheet, that is, the lateral edge of the conveyance span 13IN of the 13-inch sheet in the axial direction of the fixing belt 21. The slope 43 is gently tilted downward toward the center of the fixing belt 21 in the axial direction thereof. The second comparative fixing device 20C not incorporating the laminated heat generators 23C, 23D, 23CS, and 23CT controls the fixing property of heating the fixing belt 21 throughout the maximum conveyance span by modifying the shape of the slope 43. Conversely, the laminated heat generators 23C, 23D, 23CS, and 23CT control the fixing property of heating the fixing belt 21 throughout the maximum conveyance span to facilitate the heat shield 42 to shield each lateral end of the fixing belt 21 in the axial direction thereof from the first halogen heater 23A and the second halogen heater 23B.

Since the laminated heat generation portions 23C1 and 23C2 are requested to generate heat in an amount to achieve the fixing property of heating each lateral end of the sheet P in the axial direction of the fixing belt 21, each of the laminated heat generation portions 23C1 and 23C2 may be a heat generator that generates heat in an amount determined in view of the linear velocity of the fixing belt 21 or a roller used to form a toner image T on a sheet P (e.g., the registration roller pair 12 depicted in FIG. 1), the thickness of the fixing belt 21, and the like and may be energized constantly.

The laminated heat generation portions 23C1 and 23C2 may be powered on during conveyance of the sheet P over the fixing belt 21 and therefore powered off during an interval between conveyance of a first sheet P and conveyance of a second sheet P. The laminated heat generation portions 23C1 and 23C2 may be powered on and off based on the temperature of the fixing belt 21 detected by the thermopile 27 depicted in FIG. 2.

Each of the stationary heat generators 23E and 23F depicted in FIG. 12 may be divided into a plurality of heat generation portions like the laminated heat generators 23CS and 23CT depicted in FIGS. 13A and 13B, respectively. The plurality of heat generation portions may be energized separately from each other, attaining advantages similar to the advantages of the laminated heat generators 23CS and 23CT described above.

Figure 15:
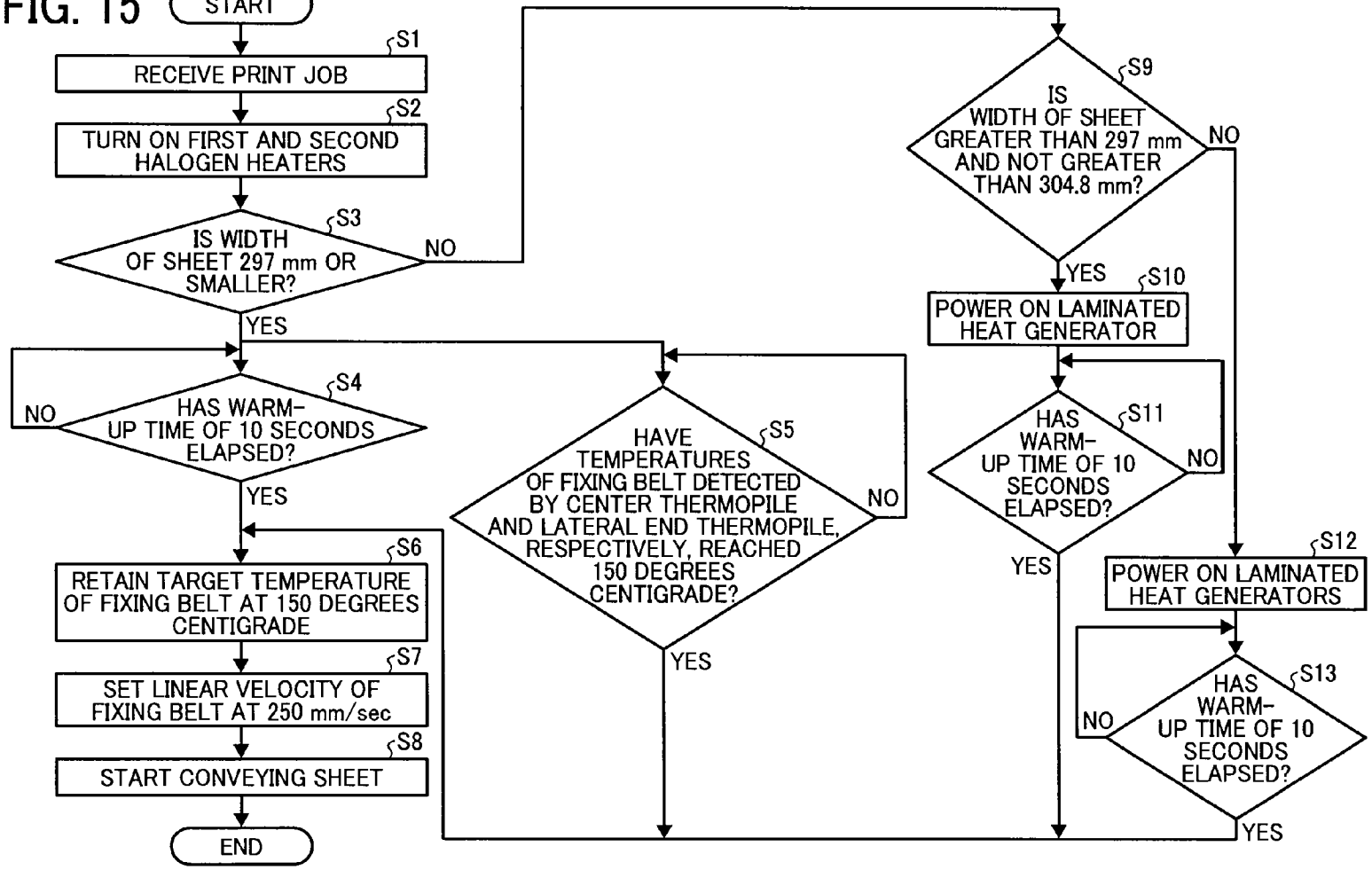
FIG. 15 is a flowchart showing processes of a fixing control performed by the fixing device shown in FIG. 8.

With reference to FIGS. 14 and 15, a description is provided of a fixing control performed by the fixing devices 20 and 20S.

FIG. 15 is a flowchart showing processes of the fixing control performed by the fixing devices 20 and 20S.

In step S1, the image forming apparatus 1 depicted in FIG. 1 receives a print job. In step S2, the controller 90 depicted in FIG. 14 starts warming up the fixing device 20, turning on the first halogen heater 23A and the second halogen heater 23B. In step S3, the controller 90 determines whether or not the width of a sheet P used for the print job is 297 mm or smaller based on information of the print job. If the width of the sheet P is 297 mm or smaller (YES in step S3), for example, if the sheet P is the A3 size sheet in portrait orientation or the A4 size sheet in landscape orientation having the width of 297 mm, the controller 90 determines whether or not a warm-up time of 10 seconds to heat the fixing belt 21 has elapsed in step S4. If the controller 90 determines that the warm-up time of 10 seconds has elapsed (YES in step S4), the controller 90 starts an image formation to form a toner image T on the sheet P and starts conveying the sheet P to the fixing device 20 in step S8. For example, the controller 90 controls the registration roller pair 12 depicted to FIG. 1, as one example, to resume rotation to convey the sheet P to the fixing device 20.

Alternatively, the controller 90 determines whether or not temperatures of the fixing belt 21 detected by the center thermopile 27A and the lateral end thermopile 27B depicted in FIG. 9, respectively, have reached 150 degrees centigrade in step S5. If the detected temperatures of the fixing belt 21 have reached 150 degrees centigrade (YES in step S5), the controller 90 starts an image formation to form a toner image T on the sheet P and starts conveying the sheet P to the fixing device 20 in step S8.

In step S6, the controller 90 retains a target temperature of the fixing belt 21 during conveyance of the sheet P over the fixing belt 21 as the center thermopile 27A and the lateral end thermopile 27B detect a temperature of 150 degrees centigrade. In step S7, the controller 90 sets the linear velocity of the registration roller pair 12 and the fixing belt 21 to convey the sheet P to 250 mm/sec. If the controller 90 determines that the width of the sheet P is greater than 297 mm (NO in step S3), the controller 90 determines whether or not the width of the sheet P is 12 inches (304.8 mm) or smaller in step S9. If the controller 90 determines that the width of the sheet P is 12 inches or smaller (YES in step S9), the controller 90 powers on the laminated heat generation portion 23C1 in step S10. In step S11, the controller 90 determines whether or not the warm-up time of 10 seconds has elapsed. If the controller 90 determines that the warm-up time of 10 seconds has elapsed (YES in step S11), the controller 90 starts conveying the sheet P in step S8 at the linear velocity of 250 mm/sec when the temperatures of the fixing belt 21 detected by the center thermopile 27A and the lateral end thermopile 27B, respectively, reach 150 degrees centigrade.

If the controller 90 determines that the width of the sheet P is greater than 12 inches (NO in step S9), the controller 90 powers on the laminated heat generation portions 23C1 and 23C2 in step S12. In step S13, the controller 90 determines whether or not the warm-up time of 10 seconds has elapsed. If the controller 90 determines that the warm-up time of 10 seconds has elapsed (YES in step S13), the controller 90 starts conveying the sheet P in step S8 at the linear velocity of 250 mm/sec when the temperatures of the fixing belt 21 detected by the center thermopile 27A and the lateral end thermopile 27B, respectively, reach 150 degrees centigrade. Accordingly, even if the sheet P bears the toner image T made of an increased amount of toner at a lateral end in the width direction thereof, the fixing device 20 fixes the toner image T on the sheet P with improved quality.

As described above, when the large sheet P such as the 12-inch sheet or a sheet greater than the 12-inch sheet is conveyed over the fixing belt 21, the controller 90 sets a fixing condition to fix the toner image T on the sheet P that is different from a fixing condition set for the regular size sheet P such as the A3 size sheet in portrait orientation or the A4 size sheet in landscape orientation, thus supplying an amount of heat sufficient to fix the toner image T on the sheet P to the fixing belt 21 and therefore improving quality of the toner image T fixed on the sheet P. The warm-up time may be adjusted according to the amount of heat generated by the laminated heat generation portions 23C1 and 23C2, performance of the fixing device 20, and the like. Alternatively, the linear velocity of the sheet P and the target temperature of the thermopile 27 may be changed to achieve the fixing property of being heated to the desired fixing temperature for the toner image T formed on each lateral end of the sheet P in the width direction thereof.

The fixing control shown in FIG. 15 is described with reference to the laminated heat generators 23CS and 23CT shown in FIGS. 13A and 13B that are disposed opposite one lateral end of the fixing belt 21 in the axial direction thereof. The fixing control is also applied to the laminated heat generators 23CS and 23CT disposed opposite another lateral end of the fixing belt 21 in the axial direction thereof and the stationary heat generators 23E and 23F shown in FIG. 12 to improve the fixing property.

Figure 16:
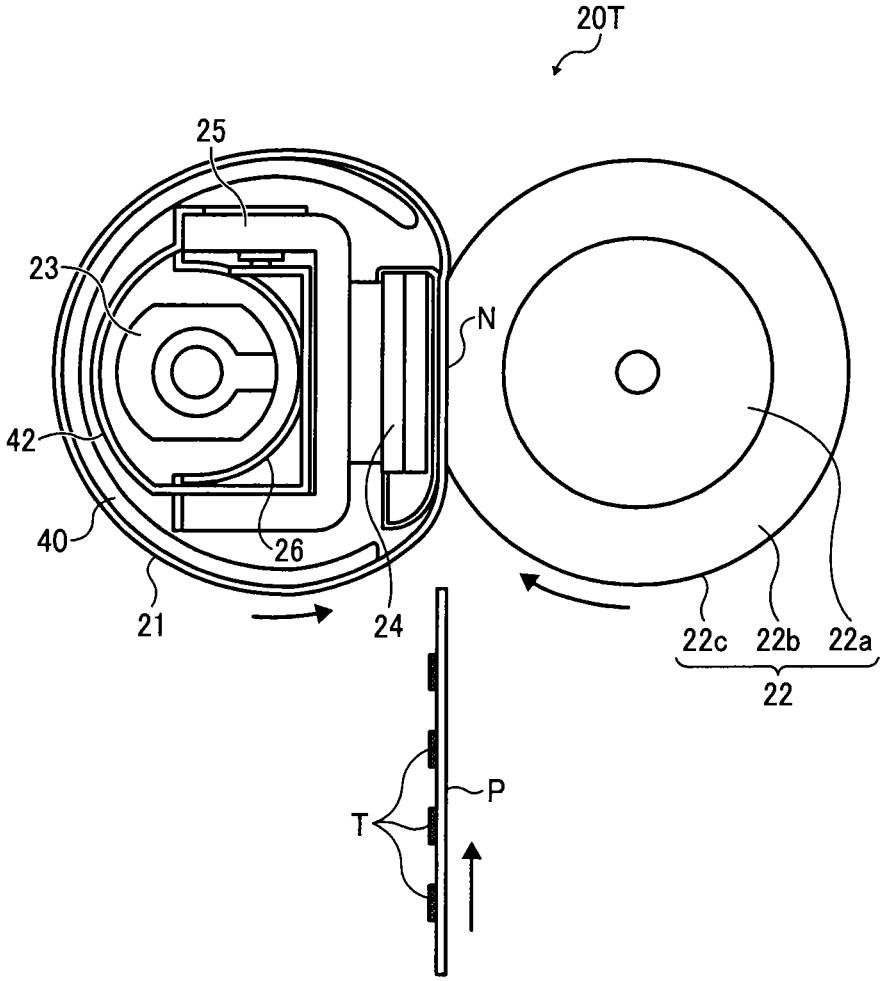
FIG. 16 is a schematic vertical sectional view of a fixing device incorporating a single halogen heater.
Figure 17:
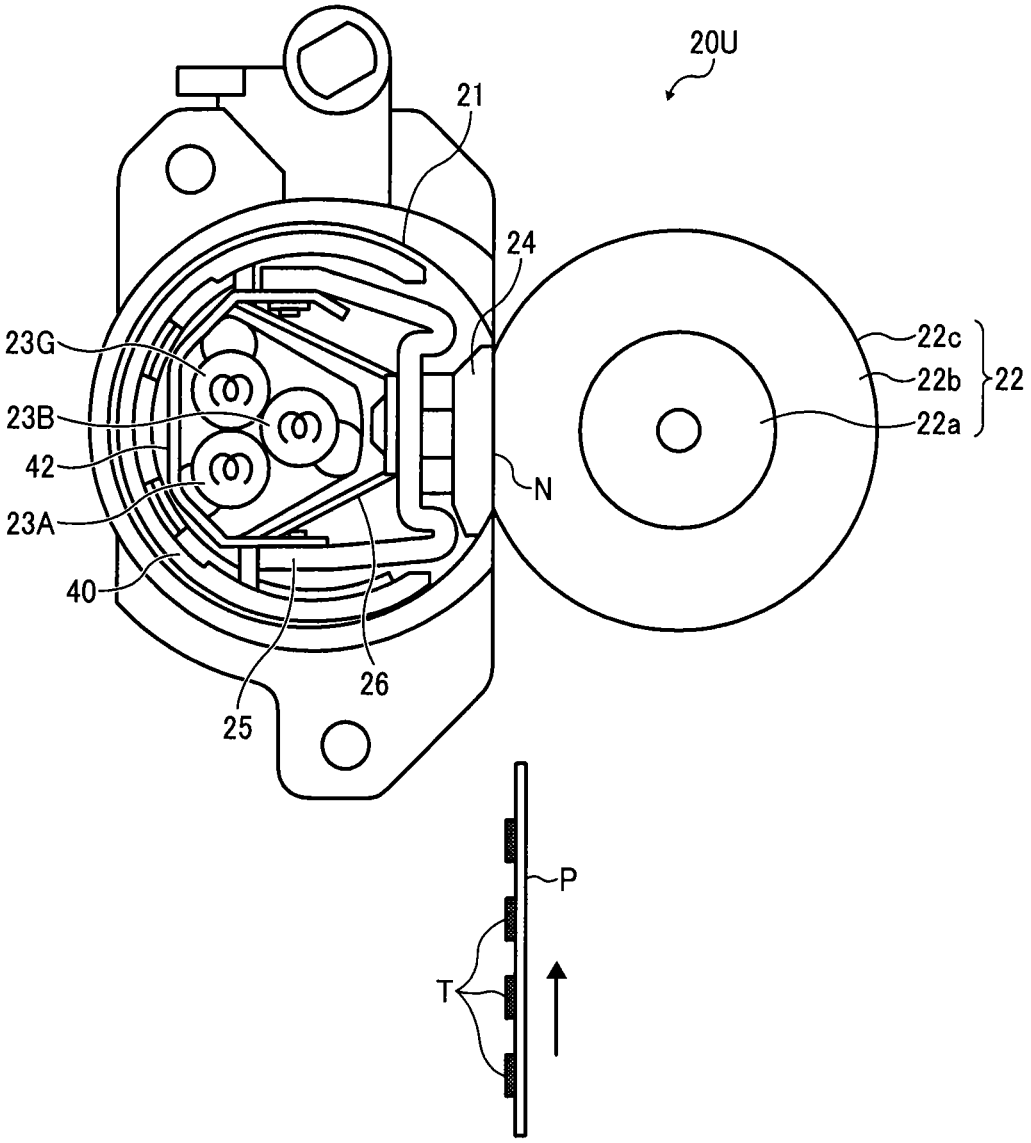
FIG. 17 is a schematic vertical sectional view of a fixing device incorporating three halogen heaters.

The fixing devices 20 and 20S depicted in FIGS. 2 and 12, respectively, incorporate the two halogen heaters 23A and 23B serving as a primary heater. Alternatively, a single halogen heater or three halogen heaters may be employed as shown in FIGS. 16 and 17. FIG. 16 is a schematic vertical sectional view of a fixing device 20T incorporating a single halogen heater 23. FIG. 17 is a schematic vertical sectional view of a fixing device 20U incorporating a third halogen heater 23G in addition to the first halogen heater 23A and the second halogen heater 23B. Regardless of the number of the halogen heaters, the fixing devices 20T and 20U may incorporate the heat shield 42, the laminated heat generators 23C, 23CS, 23CT, 23D, and the stationary heat generators 23E and 23F like the fixing devices 20 and 20S shown in FIGS. 2 and 12.

According to the exemplary embodiments described above, as shown in FIGS. 8, 9, 12, 13A, and 13B, the slope 43 is linear. Alternatively, the slope 43 may define a curve or other shapes.

The heat shield 42 blocks light or heat from the first halogen heater 23A and the second halogen heater 23B. Alternatively, the material, the configuration, or the like of the heat shield 42 may be modified to block a part of light or heat from the first halogen heater 23A and the second halogen heater 23B and transmit a part of light or heat from the first halogen heater 23A and the second halogen heater 23B. Yet alternatively, an opposed face of the heat shield 42 disposed opposite the first halogen heater 23A and the second halogen heater 23B may be treated with mirror finishing or mounted with a reflector to produce a reflection face that reflects light from the first halogen heater 23A and the second halogen heater 23B toward the fixing belt 21. In this case, the reflection face that reflects light from the first halogen heater 23A and the second halogen heater 23B toward the fixing belt 21 suppresses overheating of the heat shield 42 and reduces conduction of heat from the heat shield 42 to components surrounding the heat shield 42.

The nip formation pad 24 may mount the secondary heater (e.g., the laminated heat generators 23C, 23CS, 23CT, and 23D and the stationary heat generators 23E and 23F). However, the nip formation pad 24 is exerted with increased pressure from the pressure roller 22 and susceptible to deformation. To address this circumstance, it is necessary to change the thickness and the shape of the base pad 241 to mount the secondary heater. Additionally, a method to wind the slide sheet 240 around the base pad 241 is restricted. To address this circumstance, the heat shield 42 mounts the secondary heater as shown in FIGS. 8, 12, 13A, and 13B, attaining the mechanical strength of the nip formation pad 24 readily and preventing the method to wind the slide sheet 240 around the base pad 241 from being restricted.

A description is provided of advantages of the fixing devices 20, 20S, 20T, and 20U.

As shown in FIGS. 2, 16, and 17, a fixing device (e.g., the fixing devices 20, 20S, 20T, and 20U) includes a flexible endless fixing rotator (e.g., the fixing belt 21) rotatable in a predetermined direction of rotation (e.g., the rotation direction D21); an opposed rotator (e.g., the pressure roller 22) disposed outside the fixing rotator and disposed opposite the fixing rotator; and a nip formation pad (e.g., the nip formation pad 24) disposed inside the fixing rotator to press against the opposed rotator via the fixing rotator to form the fixing nip N between the fixing rotator and the opposed rotator. As a sheet P serving as a recording medium bearing a toner image T is conveyed through the fixing nip N, the fixing rotator and the opposed rotator fix the toner image T on the sheet P. As shown in FIGS. 9, 12, 13A, and 13B, the fixing device further includes a primary heater (e.g., the first halogen heater 23A and the second halogen heater 23B) disposed opposite the fixing rotator in a circumferential span of the fixing rotator other than the fixing nip N in a circumferential direction of the fixing rotator to heat the fixing rotator; a heat shield (e.g., the heat shield 42) interposed between the primary heater and the fixing rotator and disposed outboard from at least a decreased size recording medium conveyance span (e.g., the regular size sheet conveyance span W1) of the fixing rotator spanning in an axial direction of the fixing rotator so as to shield the fixing rotator from the primary heater; and a secondary heater (e.g., the laminated heat generators 23C, 23CS, 23CT, and 23D and the stationary heat generators 23E and 23F) mounted on the heat shield to heat the fixing rotator.

Accordingly, the secondary heater heats the fixing rotator in an increased size recording medium conveyance span (e.g., the large sheet conveyance span W2) where the large sheet P such as the A3 extension size sheet is conveyed. Thus, the fixing device attains the fixing property of heating the sheets P of various sizes.

As shown in FIG. 9, although the first halogen heater 23A and the second halogen heater 23B include the minor heat generators 45*a* and the major heat generators 44*b*, respectively, disposed outboard from the regular size sheet conveyance span W1 in the axial direction of the fixing belt 21, the heat shields 42 are disposed outboard from at least the regular size sheet conveyance span W1 in the axial direction of the fixing belt 21, suppressing redundant heating of the fixing belt 21 in the non-conveyance span where the sheet P is not conveyed over the fixing belt 21. Accordingly, overheating of the non-conveyance span of the fixing belt 21 is suppressed. The controller 90 controls the laminated heat generators 23C, 23CS, 23CT, and 23D or the stationary heat generators 23E and 23F to improve the fixing property of heating the large sheet P sufficiently even when the large sheet P is conveyed over the fixing belt 21. The fixing belt 21 is heated to temperatures not higher than the heat resistant temperature of the fixing belt 21 and therefore immune from thermal degradation and damage.

The major heat generator 44*b* of the second halogen heater 23B includes the supplementary heat generator SD that spans each inboard span D in the axial direction of the fixing belt 21. Alternatively, the major heat generator 44*b* may span within the regular size sheet conveyance span W1 so that one or more secondary heaters achieve advantages of the supplementary heat generator SD spanning outboard from the regular size sheet conveyance span W1 and the supplementary heat generator SE depicted in FIG. 5 spanning outboard from the large sheet conveyance span W2 in the axial direction of the fixing belt 21 without the aperture 53 of the heat shield 42.

The fixing devices 20, 20S, 20T, and 20U are installable in the image forming apparatus 1 depicted in FIG. 1 in which the A3 size sheet in portrait orientation and the A4 size sheet in landscape orientation that have the width of 297 mm, sheets that have the width in a range of from 12 inches to 13 inches (e.g., the 12-inch sheet having the width of 304.8 mm and the 13-inch sheet having the width of 330.2 mm) are used frequently. Alternatively, the fixing devices 20, 20S, 20T, and 20U may be installed in an image forming apparatus and the like in which an A4 size sheet in portrait orientation having the width of 210 mm and a letter size sheet in portrait orientation having the width of 215.9 mm are used frequently and an image forming apparatus and the like in which a letter size sheet in landscape orientation having the width of 279.4 mm and a double letter size sheet in portrait orientation having the width of 297.4 mm are used frequently.

The fixing devices 20, 20S, 20T, and 20U employ a center conveyance system in which the sheets P of various sizes are centered on the fixing belt 21 in the axial direction thereof as the sheets P are conveyed over the fixing belt 21 in the sheet conveyance direction A1. Alternatively, the fixing devices 20, 20S, 20T, and 20U may employ a lateral edge conveyance system in which the sheet P is conveyed in the sheet conveyance direction A1 along one lateral edge of the fixing belt 21 in the axial direction thereof as one side edge of the sheet P is positioned along the one lateral edge of the fixing belt 21 in the axial direction thereof.

The fixing devices 20, 20S, 20T, and 20U are installable in a color laser printer serving as the image forming apparatus 1 depicted in FIG. 1. Alternatively, the fixing devices 20, 20S, 20T, and 20U may be installed in a monochrome image forming apparatus, other image forming apparatuses such as a copier, a facsimile machine, a printer, and a multifunction peripheral or a multifunction printer (MFP), or the like.

The present disclosure is not limited to the details of the exemplary embodiments described above and various modifications and improvements are possible. The advantages achieved by the fixing devices 20, 20S, 20T, and 20U and the image forming apparatus 1 are not limited to those described above.

According to the exemplary embodiments described above, the fixing belt 21 serves as a fixing rotator. Alternatively, a fixing roller, a fixing film, a fixing sleeve, or the like may be used as a fixing rotator. Further, the pressure roller 22 serves as an opposed rotator. Alternatively, a pressure belt or the like may be used as an opposed rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

an opposed rotator pressed against the fixing rotator to form a fixing nip therebetween, through which a recording medium bearing a toner image is conveyed;

a primary heater disposed in a circumferential span of the fixing rotator other than the fixing nip in a circumferential direction of the fixing rotator to heat the fixing rotator;

a heat shield interposed between the primary heater and the fixing rotator and disposed outboard from at least a decreased size recording medium conveyance span of the fixing rotator spanning in an axial direction of the fixing rotator where the recording medium having a decreased size in the axial direction of the fixing rotator is conveyed, the heat shield to shield the fixing rotator from the primary heater; and a secondary heater mounted on the heat shield to heat the fixing rotator.

2. The fixing device according to claim 1, wherein the primary heater includes a supplementary heat generator disposed outboard from the decreased size recording medium conveyance span in the axial direction of the fixing rotator, and wherein the secondary heater is disposed outboard from the supplementary heat generator in the axial direction of the fixing rotator.

3. The fixing device according to claim 2, wherein the heat shield exposes the supplementary heat generator of the primary heater to the fixing rotator.

4. The fixing device according to claim 3, wherein the heat shield includes a slope tilted to gradually decrease a shield area of the heat shield that shields the fixing rotator from the primary heater toward a center of the fixing rotator in the axial direction thereof.

5. The fixing device according to claim 1, wherein the secondary heater includes:

a first heat generation portion; and a second heat generation portion separated from the first heat generation portion.

6. The fixing device according to claim 5, further comprising a voltage application circuit to energize the first heat generation portion separately from the second heat generation portion.

7. The fixing device according to claim 5, wherein the first heat generation portion is isolated from the second heat generation portion with an interval therebetween in the axial direction of the fixing rotator.

8. The fixing device according to claim 5, wherein the second heat generation portion is disposed outboard from the first heat generation portion in the axial direction of the fixing rotator.

9. The fixing device according to claim 1, wherein the secondary heater includes a laminated heat generator contoured along a surface of the heat shield.

10. The fixing device according to claim 1, wherein the secondary heater includes a stationary heat generator.

11. The fixing device according to claim 1, wherein the heat shield is contoured along an inner circumferential surface of the fixing rotator.

12. The fixing device according to claim 1, further comprising a nip formation pad to press against the opposed rotator via the fixing rotator.

13. The fixing device according to claim 1, wherein the fixing rotator includes a flexible endless belt.

14. The fixing device according to claim 1, wherein the opposed rotator includes a pressure roller.

15. The fixing device according to claim 1, wherein the primary heater includes a halogen heater.

16. An image forming apparatus comprising:

an image forming device to form a toner image; and a fixing device disposed downstream from the image forming device in a recording medium conveyance direction to fix the toner image on a recording medium, the fixing device including a fixing rotator rotatable in a predetermined direction of rotation, an opposed rotator pressed against the fixing rotator to form a fixing nip therebetween, through which the recording medium bearing the toner image is conveyed, a primary heater disposed in a circumferential span of the fixing rotator other than the fixing nip in a circumferential direction of the fixing rotator to heat the fixing rotator, a heat shield interposed between the primary heater and the fixing rotator and disposed outboard from at least a decreased size recording medium conveyance span of the fixing rotator spanning in an axial direction of the fixing rotator where the recording medium having a decreased size in the axial direction of the fixing rotator is conveyed, the beat shield to shield the fixing rotator from the primary heater, and a secondary heater mounted on the heat shield to heat the fixing rotator.

17. A fixing method comprising:

receiving a print job;

energizing a primary heater to heat a fixing rotator;

determining that a width of a recording medium is greater than a predetermined width;

energizing a secondary heater to heat the fixing rotator based on the determined width of the recording medium;

determining that a warm-up time has elapsed;

detecting a preset temperature of the fixing rotator;

rotating the fixing rotator at a preset linear velocity; and conveying the recording medium to the fixing rotator.

18. The fixing method of claim 17, wherein energizing the secondary heater further includes energizing one or more laminated heat generators, the number of laminated heat generates is based on the determined width of the recording medium.

19. The fixing device according to claim 1, wherein the recording medium having the decreased size includes a regular size sheet conveyed in a maximum conveyance span of the fixing rotator.

20. The image forming apparatus according to claim 16, wherein the recording medium having the decreased size includes a regular size sheet conveyed in a maximum conveyance span of the fixing rotator.

21. The fixing method according to claim 17, wherein the recording medium includes a regular size sheet in a maximum conveyance span of the fixing rotator.

* * * * *